US011654701B2

(12) United States Patent
Mizutani

(10) Patent No.: US 11,654,701 B2
(45) Date of Patent: May 23, 2023

(54) CUTTING DEVICE INCLUDING FIRST LEVER AND SECOND LEVER FOR MOVING CUTTER BLADE AND CUTTER CRADLE TO PERFORM CUTTING OPERATION WITH RESPECT TO CUT TARGET

(71) Applicant: BROTHER KOGYO KABUSHIKI KAISHA, Nagoya (JP)

(72) Inventor: Hiromitsu Mizutani, Ichinomiya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/539,053

(22) Filed: Nov. 30, 2021

(65) Prior Publication Data

US 2022/0176719 A1 Jun. 9, 2022

(30) Foreign Application Priority Data

Dec. 4, 2020 (JP) ..... JP2020-201610

(51) Int. Cl.

| | |
|---|---|
| ***B41J 11/66*** | (2006.01) |
| ***B41J 11/70*** | (2006.01) |
| *B41J 11/68* | (2006.01) |
| *B41J 2/315* | (2006.01) |

(52) U.S. Cl.

CPC ..... *B41J 11/70* (2013.01); *B41J 11/666* (2013.01); *B41J 11/703* (2013.01); *B41J 2/315* (2013.01); *B41J 11/68* (2013.01)

(58) Field of Classification Search

CPC ..... B41J 11/70; B41J 11/666; B41J 11/703; B41J 2/315; B41J 11/68

See application file for complete search history.

(56) References Cited

U.S. PATENT DOCUMENTS

2003/0198499 A1* 10/2003 Tsuchiya ..... B26D 1/085 400/621
2011/0158733 A1* 6/2011 Kosuge ..... B41J 11/66 400/621
2018/0273230 A1* 9/2018 Hasegawa ..... B41J 11/663

FOREIGN PATENT DOCUMENTS

JP 2005-224924 A 8/2005
JP 2005224924 A * 8/2005 ..... B26D 1/30

* cited by examiner

*Primary Examiner* — Yaovi M Ameh
(74) *Attorney, Agent, or Firm* — Kenealy Vaidya LLP

(57) ABSTRACT

A cutting device includes: a cutter blade movable between a retracted position and a cutting position; a cutter cradle facing the cutter blade; and a first lever and a second lever those operated by a user. The cutter blade performs one of a half-cutting operation and a full-cutting operation with respect to a cut target when positioned at the cutting position. The cutter cradle is movable between: a full-cutting position where the full-cutting operation is performed by the cutter blade; and a half-cutting position where the half-cutting operation is performed by the cutter blade. When the first lever is operated, the cutter blade is moved to the cutting position while the cutter cradle remains at the half-cutting position. When the second lever is operated, the cutter blade is moved to the cutting position and the cutter cradle is moved between the full-cutting position and the half-cutting position.

19 Claims, 23 Drawing Sheets

CUTTING DEVICE INCLUDING FIRST LEVER AND SECOND LEVER FOR MOVING CUTTER BLADE AND CUTTER CRADLE TO PERFORM CUTTING OPERATION WITH RESPECT TO CUT TARGET

CROSS REFERENCE TO RELATED APPLICATION

This application claims priority from Japanese Patent Application No. 2020-201610 filed Dec. 4, 2020. The entire content of the priority application is incorporated herein by reference.

BACKGROUND

There has been known a cutting device for cutting a target to be cut such as a tape, a label, a tube and the like. Further, a printer employing the above cutting device has also been known. For example, Japanese Patent Application Publication No. 2005-224924 discloses a cutting device including a motor for driving a movable blade. The movable blade is driven by the motor to cut a label sheet in cooperation with a cutter cradle.

SUMMARY

According to the conventional cutting device described above, there arises a problem that a weight of the cutting device is increased since the motor for driving the movable blade is provided therein.

In view of the foregoing, it is an object of the present disclosure to provide a cutting device whose weight is saved, and a printing device including the cutting device.

In order to attain the above and other objects, the present disclosure provides a cutting device including: a cutter blade; a cutter cradle; a first lever; and a second lever. The cutter blade is configured to cut a cut target. The cutter blade is movable between: a cutting position where the cutter blade is configured to perform one of a full-cutting operation and a half-cutting operation with respect to the cut target by making contact with the cut target; and a retracted position where the cutter blade does not make contact with the cut target. The cutter cradle faces the cutter blade. The cutter cradle is movable between: a full-cutting position at which the cutter blade is configured to perform the full-cutting operation with respect to the cut target in cooperation with the cutter cradle; and a half-cutting position at which the cutter blade is configured to perform the half-cutting operation with respect to the cut target in cooperation with the cutter cradle. The first lever is configured to be operated by a user. The first lever is configured to make contact with the cutter blade directly or indirectly. The first lever is movable from a first non-operation position to a first operation completion position. The first lever is positioned at the first non-operation position when a user operation to the first lever is not performed. The first lever is positioned at the first operation completion position when the user operation to the first lever has been completed. The second lever is configured to be operated by the user. The second lever is configured to make contact with both the cutter blade and the cutter cradle directly or indirectly. The second lever is movable from a second non-operation position to a second operation completion position. The second lever is positioned at the second non-operation position when a user operation to the second lever is not performed. The second lever is positioned at the second operation completion position when the user operation to the second lever has been completed. A movement of the first lever from the first non-operation position to the first operation completion position causes a movement of the cutter blade from the retracted position to the cutting position. A movement of the second lever from the second non-operation position to the second operation completion position causes both the movement of the cutter blade from the retracted position to the cutting position and a movement of the cutter cradle between the full-cutting position and the half-cutting position.

The cutting device described above is configured to perform one of the full-cutting operation and the half-cutting operation with respect to the cut target as the first lever and the second lever are operated by the user. With this configuration, a weight of the cutting device can be saved in comparison with a case where a motor for moving the cutter blade is mounted.

According to another aspect, the present disclosure also provides a printing device including: an accommodating portion for accommodating therein a cut target; a cover; a printing unit; and a cutting device. The cover is configured to open and close the accommodating portion. The cover includes a protruding portion. The printing unit is configured to perform printing on the cut target. The cutting device includes: a cutter blade; a cutter cradle; a first lever; and a second lever. The cutter blade is configured to cut the cut target on which printing has been performed by the printing unit. The cutter blade is movable between: a cutting position where the cutter blade is configured to perform one of a full-cutting operation and a half-cutting operation with respect to the cut target by making contact with the cut target; and a retracted position where the cutter blade does not make contact with the cut target. The cutter cradle faces the cutter blade. The cutter cradle is movable between: a full-cutting position at which the cutter blade is configured to perform the full-cutting operation with respect to the cut target in cooperation with the cutter cradle; and a half-cutting position at which the cutter blade is configured to perform the half-cutting operation with respect to the cut target in cooperation with the cutter cradle. The first lever is configured to be operated by a user. The first lever is configured to make contact with the cutter blade directly or indirectly. The first lever is movable from a first non-operation position to a first operation completion position. The first lever is positioned at the first non-operation position when a user operation to the first lever is not performed. The first lever is positioned at the first operation completion position when the user operation to the first lever has been completed. The second lever is configured to be operated by the user. The second lever is configured to make contact with both the cutter blade and the cutter cradle directly or indirectly. The second lever is movable from a second non-operation position to a second operation completion position. The second lever is positioned at the second non-operation position when a user operation to the second lever is not performed. The second lever is positioned at the second operation completion position when the user operation to the second lever has been completed. The protruding portion protrudes toward the cutter cradle to form a gap between the protruding portion and the cutter cradle in a state where the cover closes the accommodating portion. A movement of the first lever from the first non-operation position to the first operation completion position causes a movement of the cutter blade from the retracted position to the cutting position. A movement of the second lever from the second non-operation position to the second operation completion position causes both the movement of the cutter blade from the retracted position to the cutting position and a movement of the cutter cradle between the full-cutting position and the half-cutting position.

According to the printing device with the above configuration, unintentional detachment of the cutter cradle from the accommodating portion can be restrained by the protruding portion, and hindrance of movement of the cutter cradle by the protruding portion can also be restrained.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

First Embodiment

Figure 1:
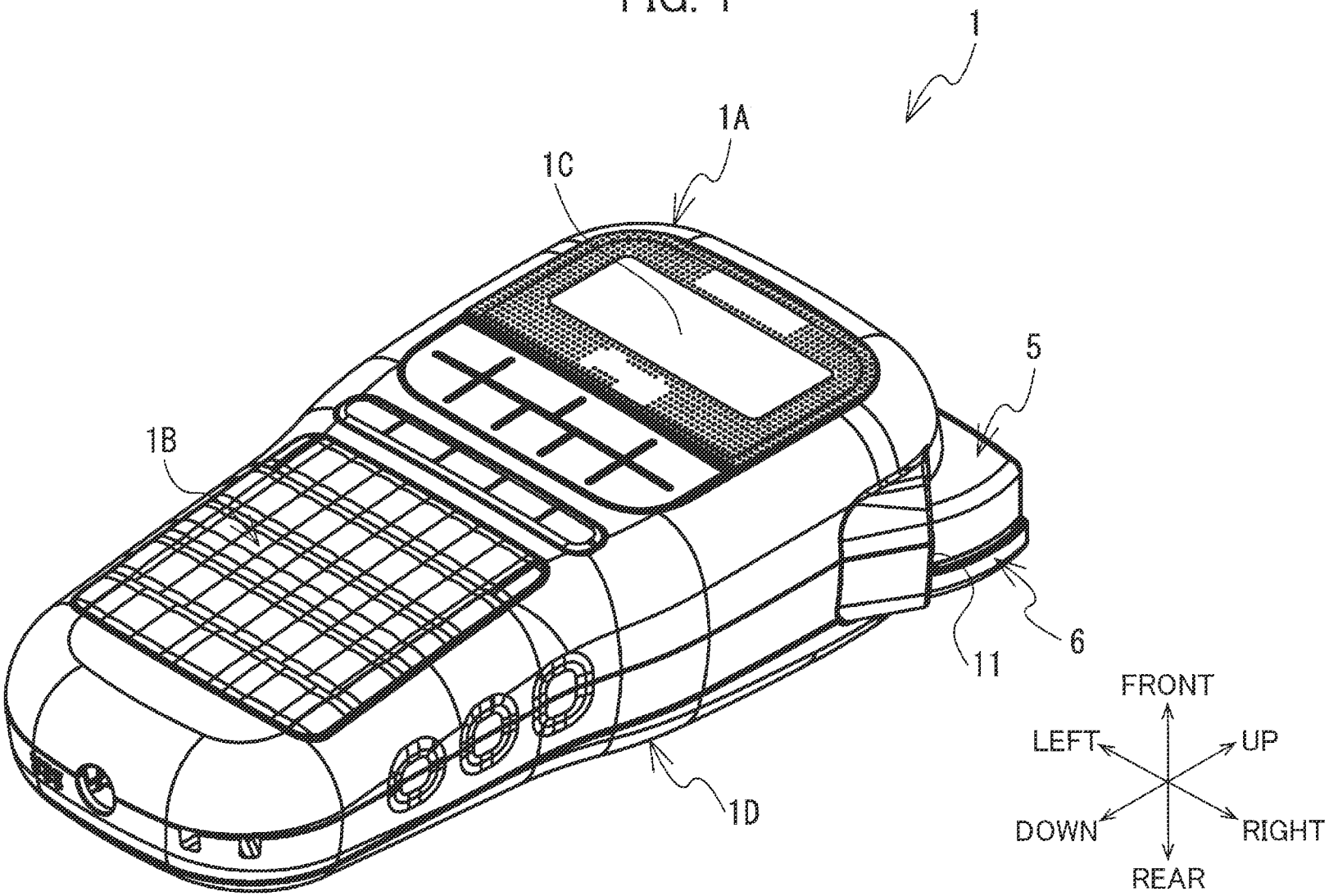
FIG. 1 is a perspective view of a printing device.

Hereinafter, a printing device 1 according to a first embodiment of the present disclosure will be described with reference to FIGS. 1 through 17.

The terms "upward", "downward", "leftward", "rightward", "frontward" and "rearward" used in the following description to describe directions correspond to the terms "up", "down", "left", "right", "front" and "rear" indicated by arrows in the drawings, respectively. Further, an upward direction and a downward direction will be collectively referred to as an up-down direction, a leftward direction and a rightward direction will be collectively referred to as a left-right direction, and a frontward direction and a rearward direction will be collectively referred to as a front-rear direction.

[Overview of Printing Device 1]

Figure 4:
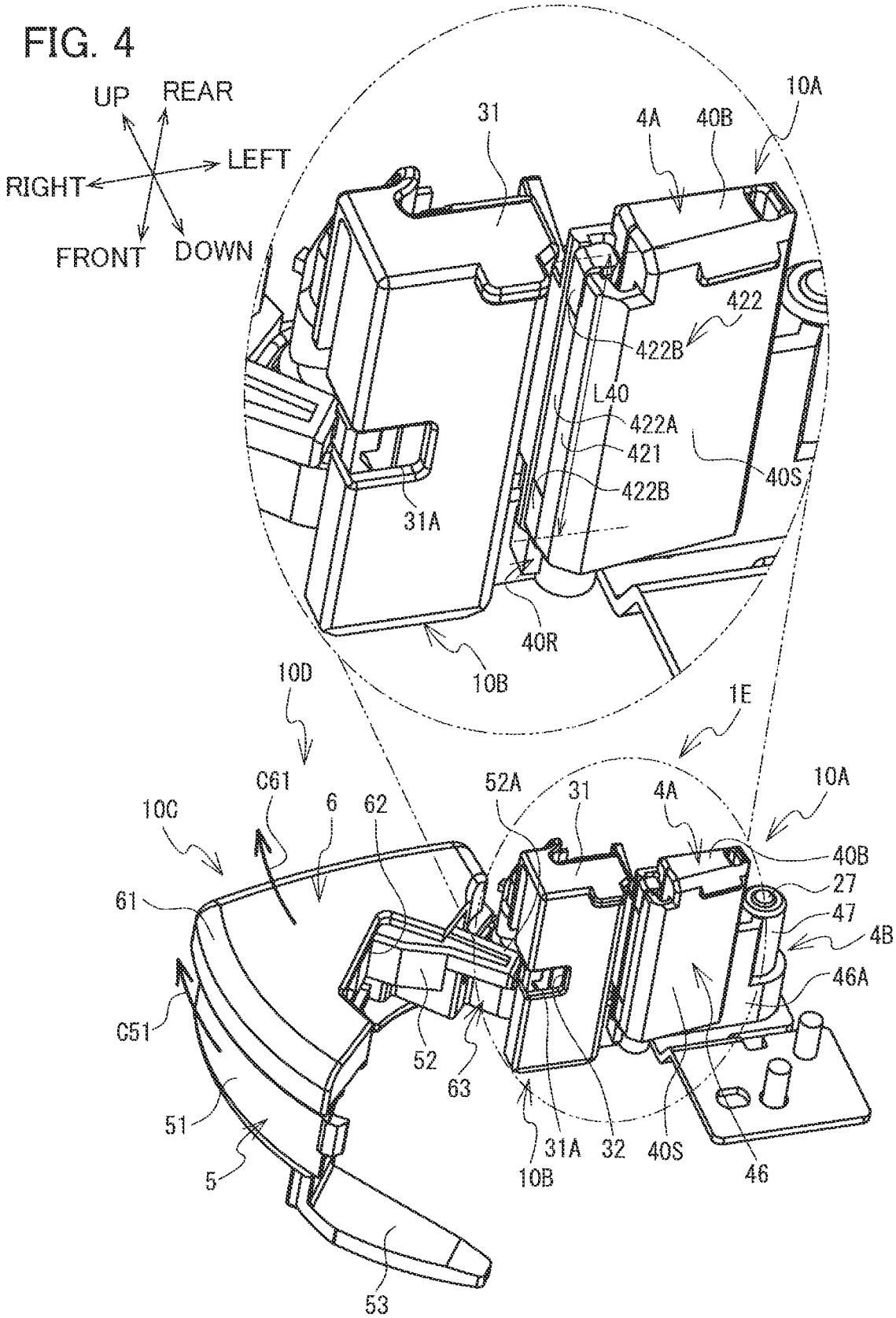
FIG. 4 is a perspective view of a cutting device of the printing device.

The printing device 1 illustrated in FIG. 1 includes a housing 1A, an operating portion 1B, a display portion 1C, a cover 1D, and a cutting device 1E (see FIG. 4). The housing 1A has a generally rectangular shape in a plan view. The operating portion 1B is disposed at a front-lower portion of the housing 1A, i.e., positioned further downward than an approximate center in the up-down direction of the housing 1A. The operating portion 1B is configured to receive input of various information by a user operation. In a user operation, a user directly touches the operating portion 1B to input information. The display portion 1C is positioned at a front portion of the housing 1A and positioned further upward than the operating portion 1B. The display portion 1C is configured to display thereon various information.

Figure 2:
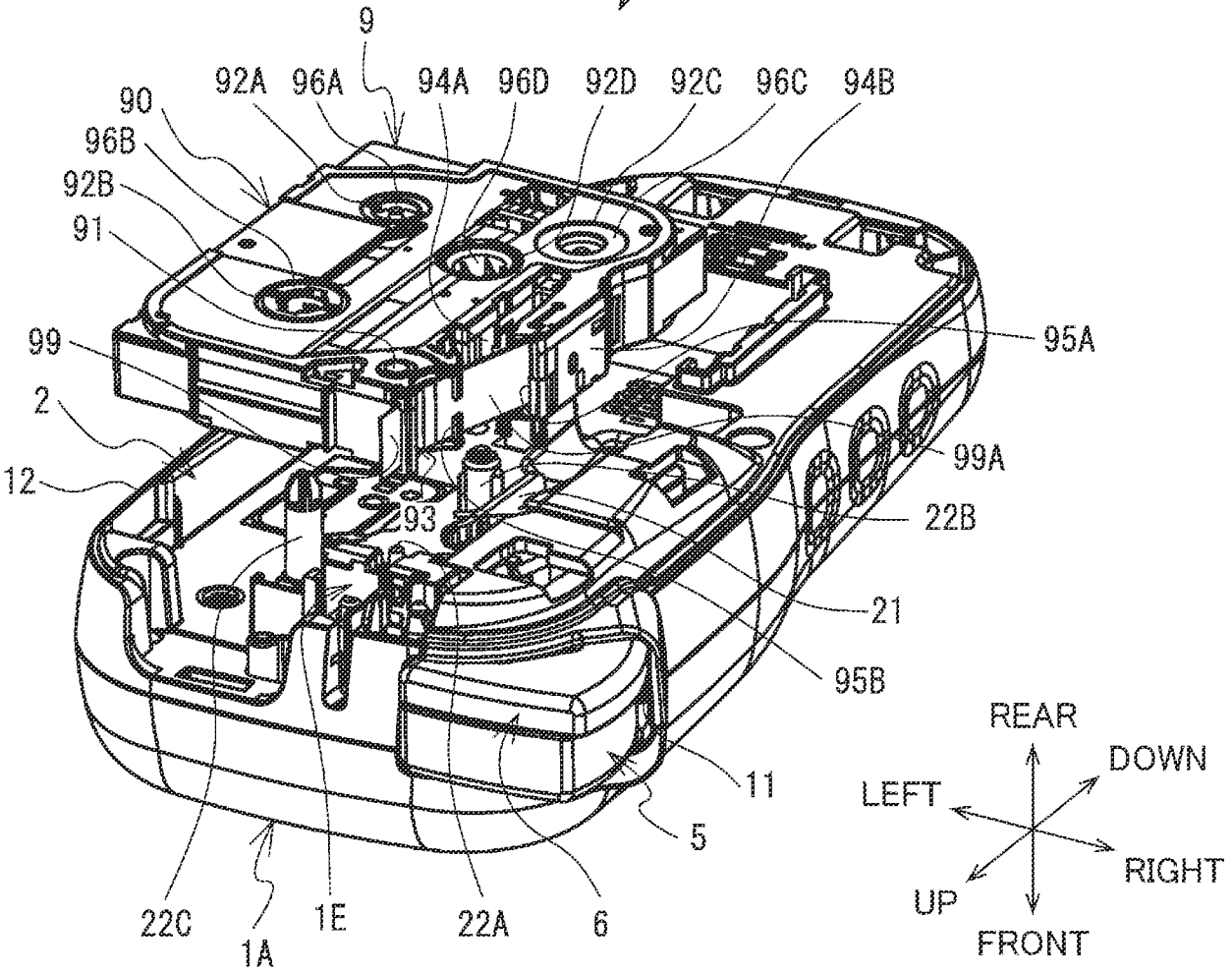
FIG. 2 is an exploded perspective view of a cassette and the printing device in which a cover is omitted.

As illustrated in FIG. 2, the printing device 1 further includes a cassette receiving portion 2 configured to receive a cassette 9. The cassette receiving portion 2 is opened or closed by the cover 1D (see FIG. 1) having a plate-like shape. The housing 1A has a rear end portion formed with an opening 12 in communication with the cassette receiving portion 2.

A head holder 21, a tape drive shaft 22A, a ribbon take-up shaft 22B, a drive motor (not illustrated), and an auxiliary shaft 22C are provided in the cassette receiving portion 2 illustrated in FIG. 2. The head holder 21 is elected rearward from a right portion of the cassette receiving portion 2. A printing head 21A (see FIG. 3) is provided on a right surface of the head holder 21. The printing head 21A is a thermal head including a plurality of heat generating elements arranged in the front-rear direction.

The tape drive shaft 22A is disposed at a position upward of the head holder 21. The ribbon take-up shaft 22B is disposed at a position leftward of the head holder 21. Each of the tape drive shaft 22A and the ribbon take-up shaft 22B is rotatable about an axis extending in the front-rear direction. The drive motor is coupled to the tape drive shaft 22A and the ribbon take-up shaft 22B and drive the same. Accordingly, the tape drive shaft 22A and the ribbon take-up shaft 22B are rotated in interlocking relation to each other upon driven by the drive motor. The auxiliary shaft 22C has an axis extending in the front-rear direction and is fixed to the cassette receiving portion 2 at a position leftward of the tape drive shaft 22A and the ribbon take-up shaft 22B.

Figure 3:
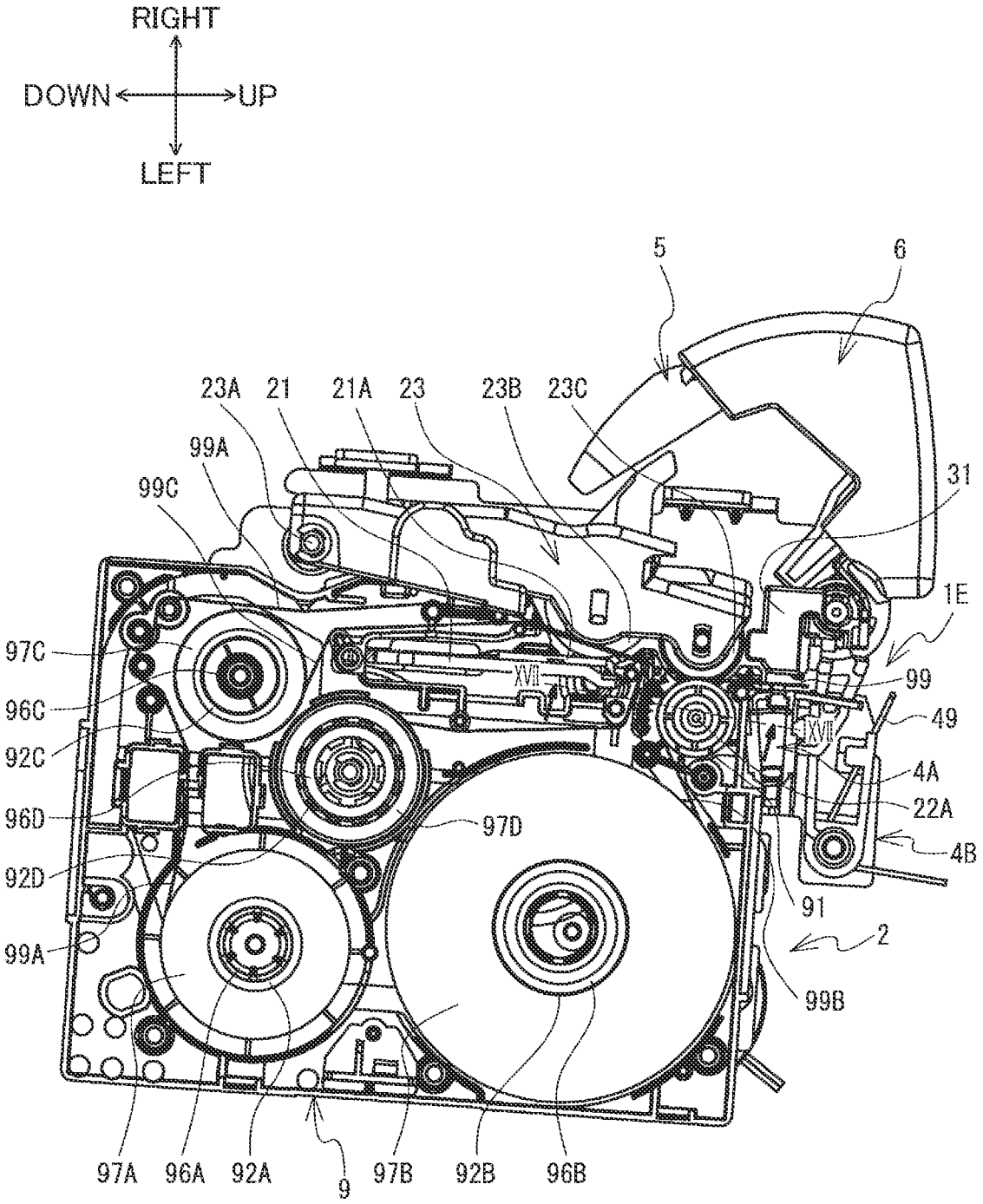
FIG. 3 is a view illustrating an internal configuration of a cassette receiving portion of the printing device and an internal configuration of the cassette.

As illustrated in FIG. 3, a platen holder 23 extending in the up-down direction is provided at a position rightward of the cassette receiving portion 2. The platen holder 23 supports a platen roller 23B and a conveying roller 23C. Each of the platen roller 23B and the conveying roller 23C is rotatable about an axis extending in the front-rear direction. The platen roller 23B is positioned rightward and faces the printing head 21A, and the conveying roller 23C is positioned rightward to face the tape drive shaft 22A.

A lower end portion of the platen holder 23 is supported by a shaft 23A extending in the front-rear direction so that the platen holder 23 is pivotally movable. Specifically, the platen holder 23 is pivotally movable about the shaft 23A between a proximity position (see FIG. 3) and a remote position (not illustrated). Ina state where the platen holder 23 is at the proximity position, the platen roller 23B and the conveying roller 23C are positioned close to the printing head 21A and the tape drive shaft 22A, respectively. In a state where the platen holder 23 is at the remote position, the platen roller 23B and the conveying roller 23C are positioned rightward to be spaced away from the printing head 21A and the tape drive shaft 22A, respectively.

The platen roller 23B is switched to a state where the platen roller 23B is coupled to and driven by the drive motor in accordance with pivotal movement of the platen holder 23 from the remote position to the proximity position. The platen holder 23 is movable from the remote position to the proximity position in accordance with a closing movement of the cover 1D for closing the cassette receiving portion 2. A position between the platen roller 23B and the printing head 21A when the platen holder 23 is at the proximity position will be referred to as "printing position".

[Overview of Cassette 9]

As illustrated in FIG. 2, a cassette 9 which is a laminate-type cassette is attachable to the cassette receiving portion 2. The cassette 9 includes a case 90 having a box-like shape. The case 90 accommodates therein a tape drive roller 91, and is formed with support holes 92A, 92B, 92C, and 92D those penetrate the case 90 in the front-rear direction, and an ejecting portion 93.

The tape drive roller 91 is positioned in a right-upper corner portion of the case 90, and has a hollow cylindrical shape extending in the front-rear direction. The tape drive roller 91 is rotatably supported by the case 90. The tape drive shaft 22A is inserted into an interior space of the tape drive roller 91 in a state where the cassette 9 is mounted on the cassette receiving portion 2.

The support hole 92A rotatably supports a first tape spool 96A. A transparent film tape 99A is wound over the first tape spool 96A to constitute a first tape roll 97A. The transparent film tape 99A is paid out from the first tape roll 97A by rotation of the first tape roll 97A along with rotation of the first tape spool 96A about an axis extending in the front-rear direction.

The support hole 92B rotatably supports a second tape spool 96B. A double-sided adhesive tape 99B is wound over the second tape spool 96B to constitute a second tape roll 97B. The double-sided adhesive tape 99B is a double-sided tape having one surface to which a release sheet is adhered. As the second tape roll 97B is rotated in accordance with rotation of the second tape spool 96B about an axis extending in the front-rear direction, the double-sided adhesive tape 99B is paid out from the second tape roll 97B. The double-sided adhesive tape 99B is directed toward the tape drive roller 91. The auxiliary shaft 22C is inserted into an interior space of the support hole 92B when the cassette 9 is attached to the cassette receiving portion 2.

The support hole 92C rotatably supports a ribbon spool 96C. A new (non-used) ink ribbon 99C is wound over the ribbon spool 96C to constitute a ribbon roll 97C. The ink ribbon 99C is paid out from the ribbon roll 97C upon rotation of the ribbon roll 97C in accordance with rotation of the ribbon spool 96C about an axis extending in the front-rear direction.

The support hole 92D rotatably supports a ribbon take-up spool 96D. A used ink ribbon 99C is configured to be wound over the ribbon take-up spool 96D to constitute a ribbon take-up roll 97D. The used ink ribbon 99C is taken up by the ribbon take-up spool 96D to form the ribbon take-up roll 97D by rotation of the ribbon take-up roll 97D along with rotation of the ribbon take-up spool 96D about an axis extending in the front-rear direction. The ribbon take-up shaft 22B is inserted into an interior space of the support hole 92D when the cassette 9 is attached to the cassette receiving portion 2.

The ejecting portion 93 has an opening that is open in the up-down direction at a position rightward and upward of the tape drive roller 91.

The case 90 is formed with a head opening 94A into which the head holder 21 can be inserted. The head opening 94A is formed in a right portion of the case 90 to penetrate the case 90 in the front-rear direction. The case 90 includes an arm portion 94B at a position rightward of the head opening 94A. The arm portion 94B extends in the up-down direction, and has an upper end portion at which a first tape guide 95A (see FIG. 3) is provided. The first tape guide 95A is an opening portion through which the ink ribbon 99C and the transparent film tape 99A positioned rightward of the ink ribbon 99C are discharged.

The transparent film tape 99A and the ink ribbon 99C discharged out of the first tape guide 95A passes through the head opening 94A, and then directed toward a second tape guide 95B formed in the cassette 9. The second tape guide 95B is an opening formed between the head opening 94A and the tape drive roller 91. The ink ribbon 99C is separated from the transparent film tape 99A and is conveyed leftward at a portion between the second tape guide 95B and the tape drive roller 91, and then taken up by the ribbon take-up spool 96D. In the following description, a position at which the ink ribbon 99C is separated from the transparent film tape 99A will be referred to as "separating position."

The transparent film tape 99A conveyed to a portion upward of the separating position is directed to the tape drive roller 91 at which the transparent film tape 99A is to be superposed on a right surface (another surface) of the double-sided adhesive tape 99B. In the following description, a combination of the transparent film tape 99A and the double-sided adhesive tape 99B superposed on each other will be referred to as "cut target 99". The cut target 99 is a tape whose widthwise direction is coincident with the front-rear direction. The cut target 99 has a thickness of, for example, 100 μm.

[Cutting Device 1E]

As illustrated in FIG. 3, the cutting device 1E is disposed further upward than the tape drive shaft 22A. As illustrated in FIG. 4, the cutting device 1E includes a cradle portion 10A, a cutter portion 10B, and a lever portion 10C. The cutting device 1E is configured to perform a cutting operation with respect to the cut target 99 by virtue of cooperation of a cutter cradle 4A of the cradle portion 10A and a cutter blade 30 (see FIG. 9) of the cutter portion 10B. The cutting operation is carried out by a user operation with respect to the lever portion 10C.

The cutting operation is classified into a full-cutting operation and a half-cutting operation. By the full-cutting operation, the cut target 99 is completely cut in a thickness direction thereof along an extending direction of a cutting edge of the cutter blade 30 and is divided into two parts. Note that the extending direction of the cutting edge is coincident with the front-rear direction. By the half-cutting operation, the cut target 99 is partially cut. That is, a cut is formed in a thickness direction of the cut target 99, but the cut target 99 is not divided into two-parts in the half-cutting operation.

[Cutter Portion 10B]

Figure 8:
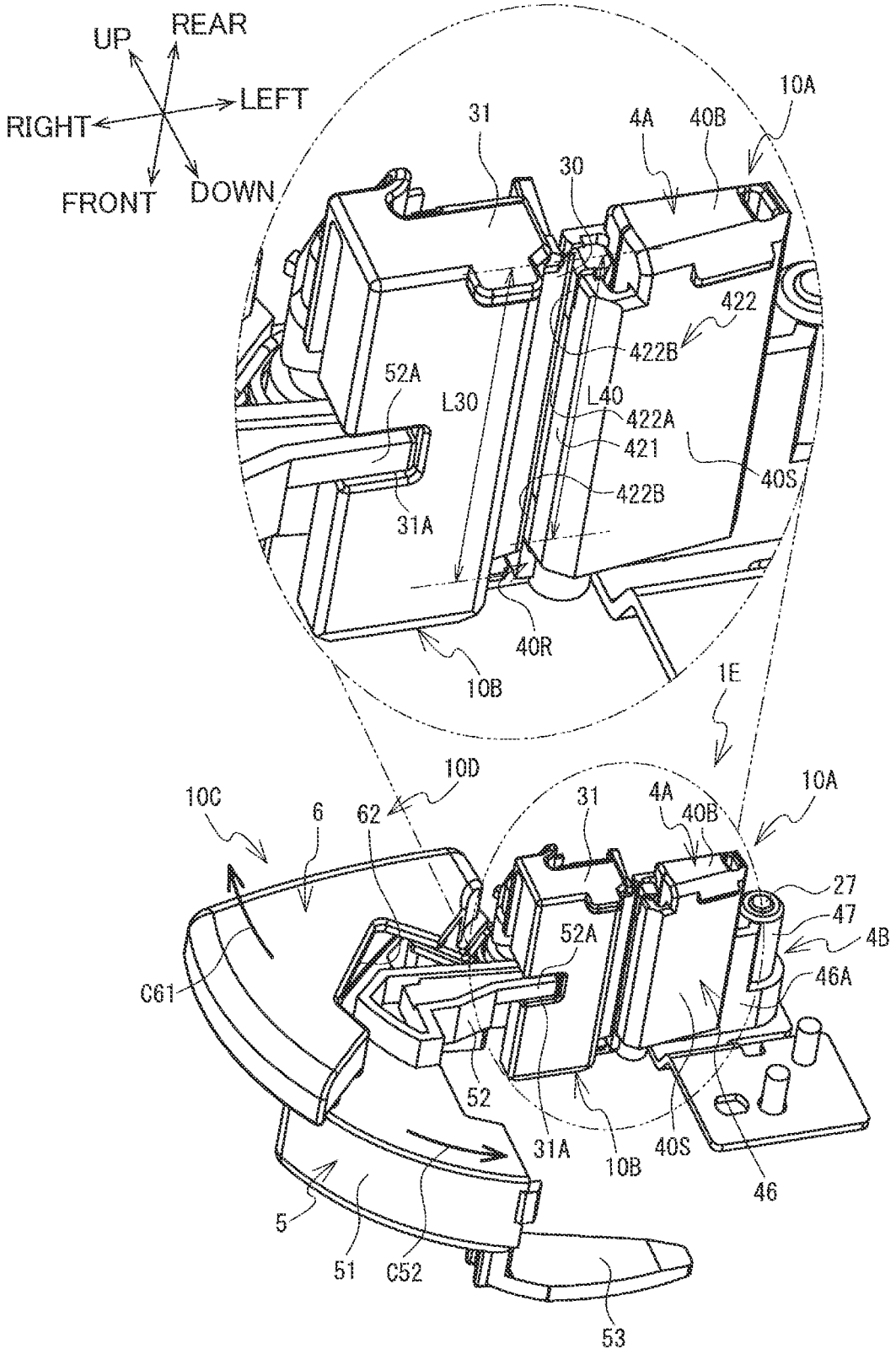
FIG. 8 is a perspective view of the cutting device.
Figure 10:
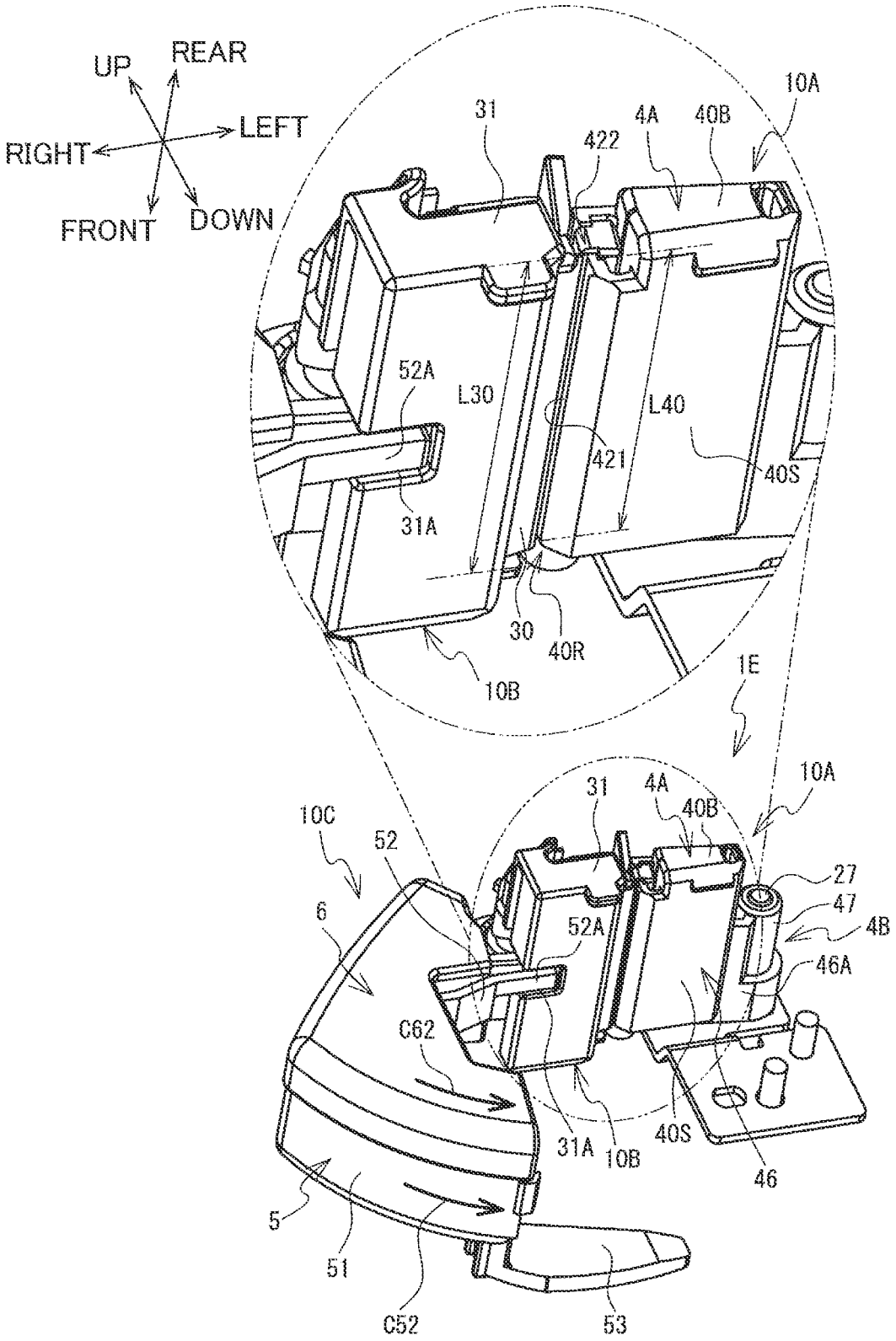
FIG. 10 is a perspective view of the cutting device.

The cutter portion 10B is configured to perform the cutting operation with respect to the cut target 99 in cooperation with the cradle portion 10A (described later). As illustrated in FIGS. 4, 8, and 10, the cutter portion 10B further includes a box member 31, a cutter holder 32, and a cutter spring (not illustrated). FIGS. 4,8 and 10 are perspective views of the cutting device 1E as viewed from a diagonally right-lower side of the cutting device 1E. The box member 31 is open leftward. A center portion in the front-rear direction of a right end portion of the box member is formed with a notched hole 31A opening rightward and extending in the up-down direction.

The cutter holder 32 is positioned inside the box member 31 and is movable in the left-right direction. The cutter holder 32 has a left end portion holding the cutter blade 30 (see FIGS. 8 and 10) for cutting the cut target 99. The cutter blade 30 has a plate shape having a thickness in the up-down direction. The cutter blade 30 has a left edge forming the cutting edge extending in the front-rear direction. The cutter blade 30 is movable in the left-right direction together with the cutter holder 32.

The cutter blade 30 is accommodated in the box member 31 (see FIG. 4) when the cutter holder 32 is at its rightmost position within a movable range thereof. On the other hand, the cutter blade 30 protrudes leftward from the box member 31 (see FIGS. 8 and 10) when the cutter holder 32 is at its leftmost position within the movable range thereof. As illustrated in FIGS. 8 and 10, the cutter blade 30 has a length "L30" in the extending direction of the cutting edge (i.e., the front-rear direction).

In the following description, a position of the cutter blade 30 accommodated in the box member 31 as illustrated in FIG. 4 will be referred to as "retracted position". The cutter blade 30 is separated from the cut target 99 and does not make contact with the cut target 99 when the cutter blade 30 is at the retracted position. Further, a position of the cutter blade 30 protruding leftward from the box member 31 as illustrated in FIGS. 8 and 10 will be referred to as "cutting position". The cutter blade 30 makes contact with the cut target 99 when the cutter blade 30 is at the cutting position.

The cutter spring (not illustrated) is positioned inside the box member 31. The cutter spring urges the cutter holder 32 so that the cutter blade 30 is urged from the cutting position toward the retracted position.

[Lever Portion 10C]

The lever portion 10C is configured to cause the cutter portion 10B and the cradle portion 10A (described later) to be moved in response to input of the user operation to the lever portion 10C. As illustrated in FIG. 4, the lever portion 10C includes a cutter lever 5, a cutter cradle lever 6, and a cutter lever spring (not illustrated). The cutter lever 5 and the cutter cradle lever 6 are arranged in the front-rear direction. Specifically, the cutter lever 5 is positioned frontward of the cutter cradle lever 6. Inside the housing 1A, the cutter lever 5 and the cutter cradle lever 6 are supported by a lever shaft 100 (see FIG. 6) extending in the front-rear direction so as to be pivotally movable about the lever shaft 100. Each of the cutter lever 5 and the cutter cradle lever 6 is pivotally movable by the user operation.

FIGS. 4 through 7 illustrate respective positions of the cutter lever 5 and the cutter cradle lever 6 those are not operated by the user. In the following description, unless otherwise specified, shapes and configurations of the cutter lever 5 and the cutter cradle lever 6 will be described based on the directions in the printing device 1 such as the front-rear direction, the left-right direction, and the up-down direction under an assumption that the user operation is not performed.

As illustrated in FIGS. 4 through 7, the cutter lever 5 includes a sleeve portion 50, an operation portion 51, a protruding portion 52, and an extending portion 53. The operation portion 51 is a portion that can be operated by the user. In the meantime, the housing 1A has a right-upper corner portion formed with an opening 11 (see FIGS. 1 and 2). The operation portion 51 protrudes outward, i.e., rightward and upward from the housing 1A through the opening 11.

The sleeve portion 50 is provided on a left end portion of the operation portion 51. The sleeve portion 50 has a hollow cylindrical shape and defines an interior space therein. The lever shaft 100 (see FIG. 6) and a connecting portion 63B (see FIGS. 13 through 15) of the cutter cradle lever 6 (described later) are inserted through the interior space of the sleeve portion 50 to allow a pivotal movement of the sleeve portion 50 about the lever shaft 100. With this configuration, the operation portion 51 is pivotally movably supported by the lever shaft 100 through the sleeve portion 50.

The protruding portion 52 is provided on a rear surface of the operation portion 51 to protrude rearward therefrom. The protruding portion 52 includes an entry portion 52A extending diagonally leftward and downward. The extending portion 53 extends diagonally leftward and downward from a right-lower corner portion of the operation portion 51.

The cutter lever spring (not illustrated) is a torsion spring provided over the lever shaft 100. The cutter lever spring urges the cutter lever 5 in a clockwise direction indicated by an arrow C51 in FIG. 4 as viewed from a rear side of the cutter lever 5. The most urged position of the cutter lever 5 in the clockwise direction C51 due to an urging force of the cutter lever spring will be referred to as "half-cutting standby position". When the cutter lever 5 is not operated by the user, the cutter lever 5 is urged by the cutter lever spring to be positioned at the half-cutting standby position. Accordingly, FIGS. 4 to 7 illustrate the cutter lever 5 at the half-cutting standby position.

On the other hand, in response to a user operation to the operation portion 51 of the cutter lever 5, the cutter lever 5 is pivotally moved in a direction opposite the direction C51, i.e., in a counterclockwise direction indicated by an arrow C52 against the urging force of the cutter lever spring as illustrated in FIG. 8. The most moved position of the cutter lever 5 in the counterclockwise direction C52 will be referred to as "half-cutting operation position."

As illustrated in FIGS. 4 through 7, the cutter cradle lever 6 includes an operation portion 61, a contacting portion 62 (see FIGS. 13 through 15), an extending portion 63, and a cutter cradle lever spring (not illustrated). The operation portion 61 is a portion that can be operated by the user. The operation portion 61 is positioned rearward of the operation portion 51 of the cutter lever 5. Similar to the operation portion 51 of the cutter lever 5, the operation portion 61 protrudes outward (rightward and upward) through the opening 11 of the housing 1A. The operation portion 61 has a shape substantially coincident with that of the operation portion 51 in a plan view.

The contacting portion 62 is provided at a front surface of the operation portion 61 to protrude frontward therefrom. The contacting portion 62 can make contact with the protruding portion 52 of the cutter lever 5. In the following description, a combination of the protruding portion 52 and the contacting portion 62 will be occasionally referred to as "interlocking portion 10D".

Figure 5:
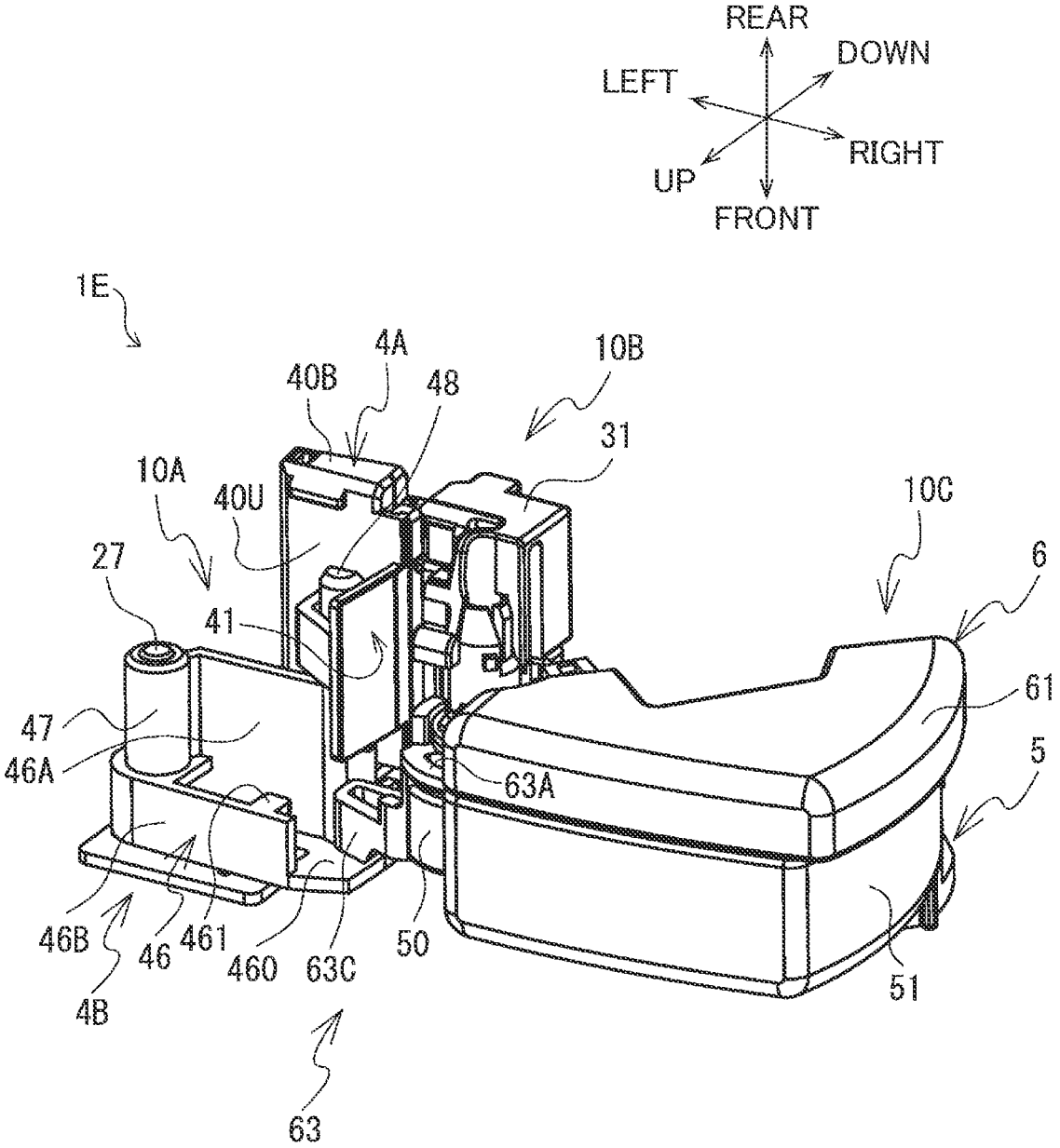
FIG. 5 is another perspective view of the cutting device.

As illustrated in FIG. 5, the operation portion 61 has a left end portion at which the extending portion 63 is provided. FIG. 5 is a perspective view of the cutting device 1E as viewed from a right-upper side of the cutting device 1E. The extending portion 63 includes a disc portion 63A, the connecting portion 63B (see FIGS. 13 through 15), and an arm portion 63C. The disc portion 63A extends leftward from a left end portion of the operation portion 61 along a rear surface of the sleeve portion 50 of the cutter lever 5. A circular hole is formed at a center portion of the disc portion 63A to penetrate the same in the front-rear direction.

The connecting portion 63B has a hollow cylindrical shape formed with a through-hole extending in the front-rear direction. The connecting portion 63B extends frontward from a front surface of the disc portion 63A through the interior space of the sleeve portion 50 of the cutter lever 5. The connecting portion 63B has a front end portion protruding further frontward than the sleeve portion 50 of the cutter lever 5. The through-hole of the connecting portion 63B is in communication with the hole of the disc portion 63A.

Figure 6:
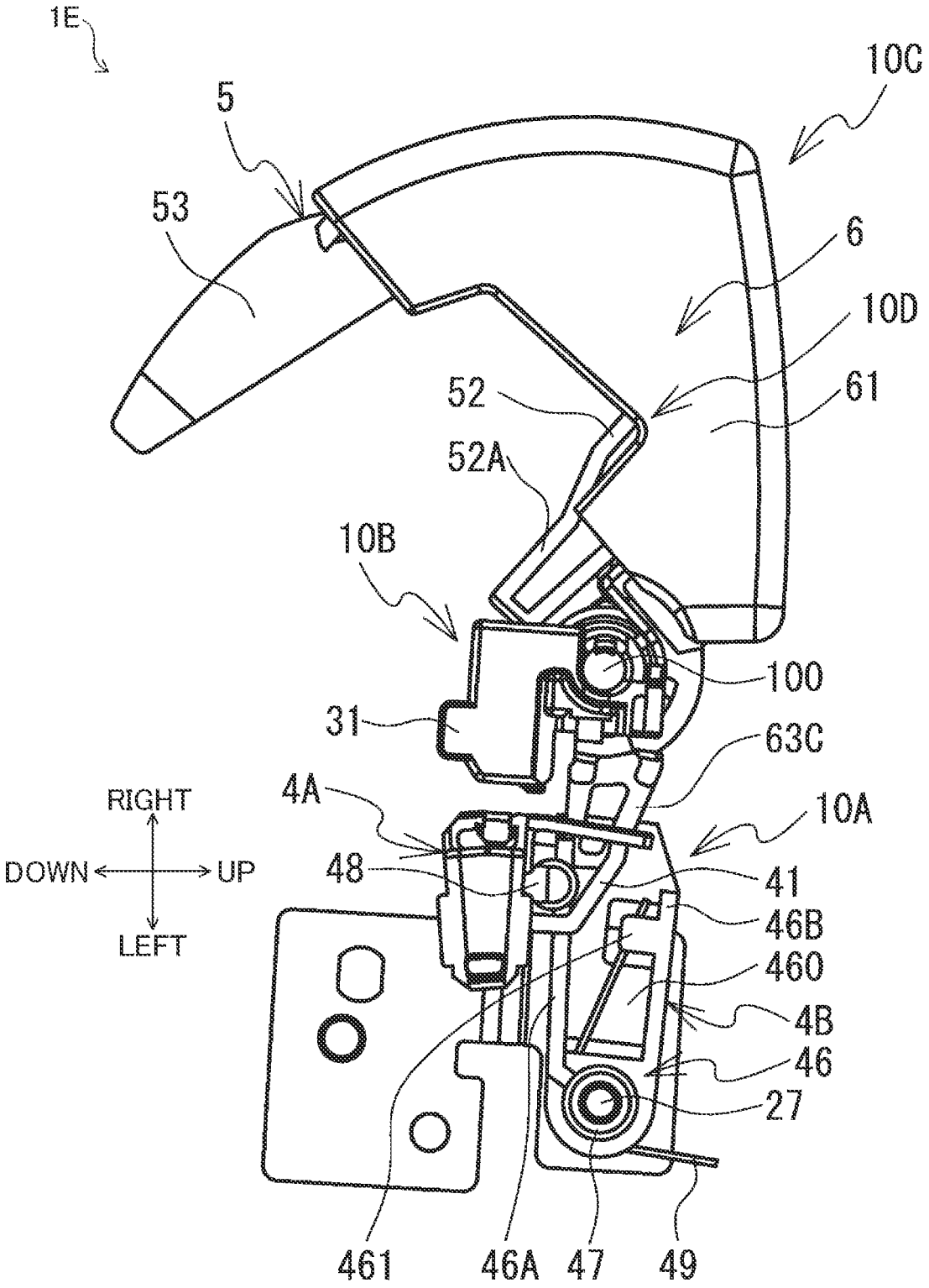
FIG. 6 is a rear side view of the cutting device.
Figure 7:
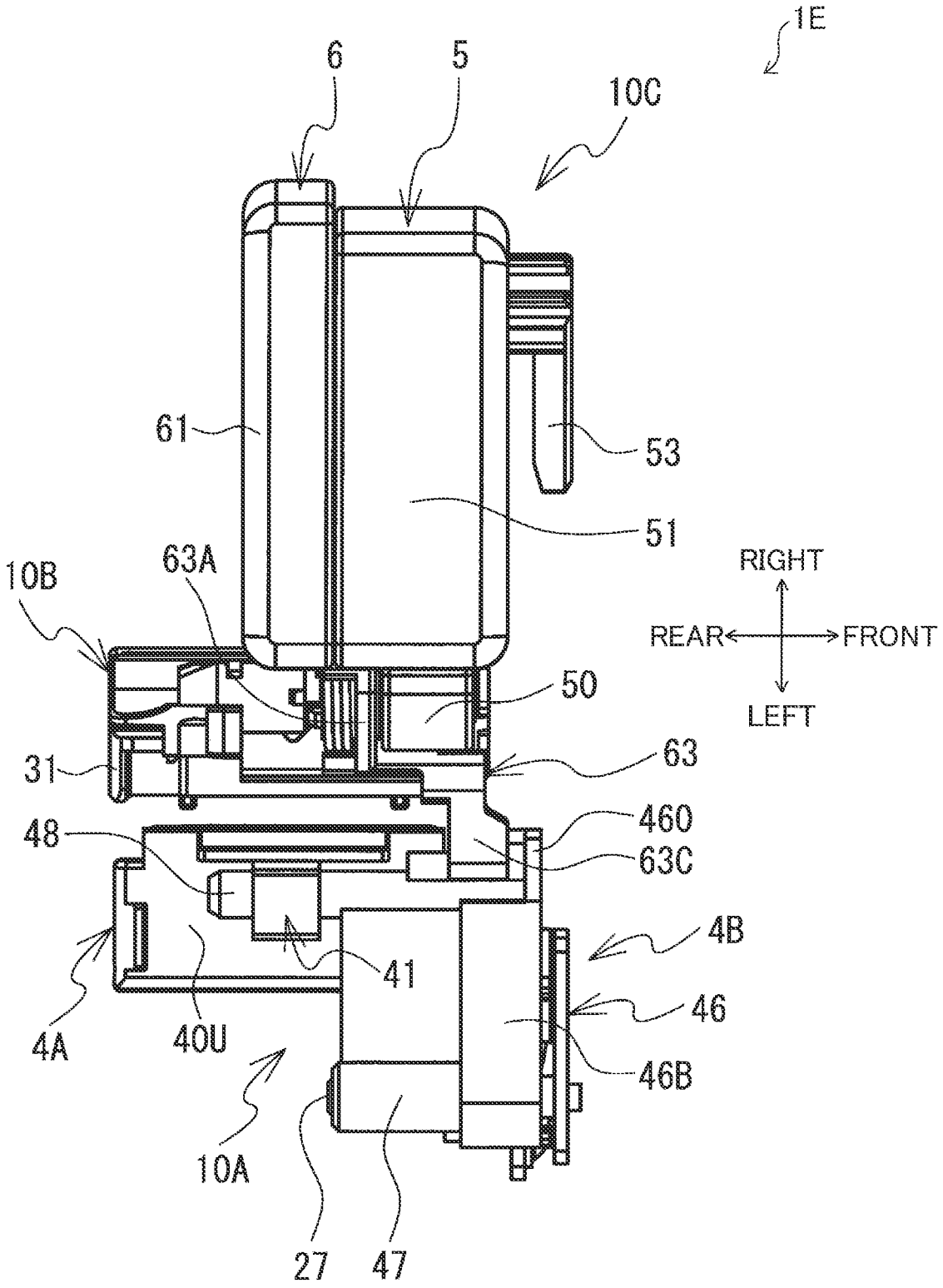
FIG. 7 is an upper side view of the cutting device.

The lever shaft 100 (see FIG. 6) is inserted through the through-hole of the connecting portion 63B to allow a pivotal movement of the connecting portion 63B about the lever shaft 100. That is, the operation portion 61 is pivotally movably supported by the lever shaft 100 through the disc portion 63A and the connecting portion 63B. As illustrated in FIG. 6, the arm portion 63C extends leftward and from a left end portion of the connecting portion 63B. The arm portion 63C is formed with a through-hole 631 (see FIG. 11) penetrating the arm portion 63C in the front-rear direction.

The cutter cradle lever spring (not illustrated) is a torsion spring provided over the lever shaft 100. The cutter cradle lever spring urges the cutter cradle lever 6 in a clockwise direction as indicated by an arrow C61 in FIGS. 4 and 8 as viewed from a rear side of the cutter cradle lever 6. The most urged position of the cutter cradle lever 6 in the clockwise direction C61 because of the urging force of the cutter cradle lever spring will be referred to as "full-cutting standby position". When the cutter cradle lever 6 is not operated by the user, the cutter cradle lever 6 is urged by the cutter cradle lever spring and is positioned at the full-cutting standby position. Accordingly, FIGS. 4 to 7 illustrate the cutter cradle lever 6 positioned at the full-cutting standby position.

On the other hand, as illustrated in FIG. 10, in response to a user operation to the operation portion 61 of the cutter cradle lever 6, the cutter cradle lever 6 is pivotally moved in a direction opposite the direction C61, i.e., in a counter-clockwise direction indicated by an arrow C62 against the urging force of the cutter cradle lever spring. The most moved position of the cutter cradle lever 6 in the counter-clockwise direction C62 will be referred to as "full-cutting operation position".

Note that, when the operation portion 61 of the cutter cradle lever 6 is operated by the user, the contacting portion 62 of the cutter cradle lever 6 is brought into contact with the protruding portion 52 of the cutter lever 5 to apply a force directed in the direction indicated by the arrow C52 to the cutter lever 5. By the application of the force to the cutter lever 5, the cutter lever 5 is pivotally moved in the direction C52 in interlocking relation to the pivotal movement of the cutter cradle lever 6.

That is, movement of the cutter lever 5 from the half-cutting standby position to the half-cutting operation position is simultaneously performed in interlocking relation to the movement of the cutter cradle lever 6 from the full-cutting standby position to the full-cutting operation position by the user operation only to the cutter cradle lever 6, as illustrated in FIG. 10. On the other hand, when the cutter lever 5 is moved from the half-cutting standby position to the half-cutting operation position by the user operation only to the cutter lever 5, the movement of the cutter cradle lever 6 in accordance with the movement of the cutter lever 5 is not performed, and the cutter cradle lever 6 is maintained at the full-cutting standby position (see FIG. 8).

During a process of the movement of the cutter lever 5 from the half-cutting standby position (see FIG. 4) to the half-cutting operation position (see FIGS. 8 and 10), the entry portion 52A of the cutter lever 5 enters the notched hole 31A of the box member 31 of the cutter portion 10B. At this time, the cutter holder 32 positioned inside the box member 31 receives a force applied from the entry portion 52A be moved leftward, thereby moving the cutter blade 30 leftward from the retracted position to the cutting position. As illustrated in FIGS. 8 and 10, the cutter blade 30 positioned at the cutting position protrudes leftward from the box member 31.

[Cradle Portion 10A]

The cradle portion 10A is configured to switch the cutting operation with respect to the cut target 99 in cooperation with the cutter portion 10B between the full-cutting operation and the half-cutting operation in accordance with the user operation to the lever portion 10C. As illustrated in FIGS. 4 through 7, the cradle portion 10A includes the cutter cradle 4A and a pivot member 4B.

Figure 12:
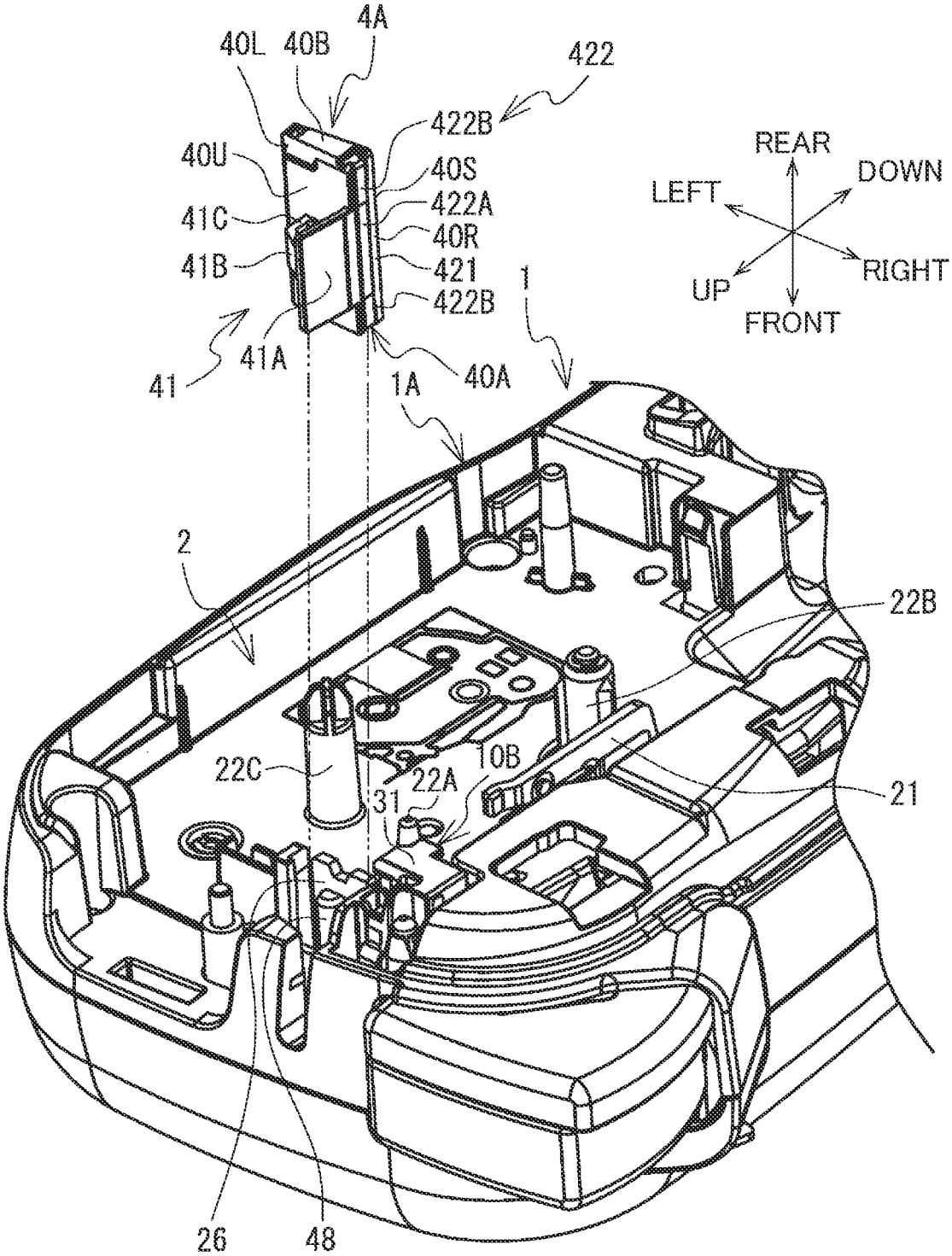
FIG. 12 is an exploded perspective view of the printing device in which a cutter cradle is detached from a support portion.

The cutter cradle 4A has a generally rectangular-parallelepiped shape (a box-like shape) and elongated in the front-rear direction. The cutter cradle 4A is disposed leftward of the cutter holder 32 to face the same. As illustrated in FIG. 12, the cutter cradle 4A includes an upper wall 40U, a lower wall 40S, a rear wall 40B, a right wall 40R, and a left wall 40L. The upper wall 40U, the lower wall 40S, the rear wall 40B, the right wall 40R, and the left wall 40L constitute an upper end, a lower end, a rear end, a right end, and a left end of the cutter cradle 4A, respectively.

The right wall 40R extends perpendicularly to the left-right direction, and is positioned leftward of the cutter holder 32. The upper wall 40U is connected to an upper end of the right wall 40R. The lower wall 40S is connected to a lower end of the right wall 40R. The upper wall 40U and the lower wall 40S is positioned to extend away from the cutter holder 32, i.e., leftward.

Figure 13:
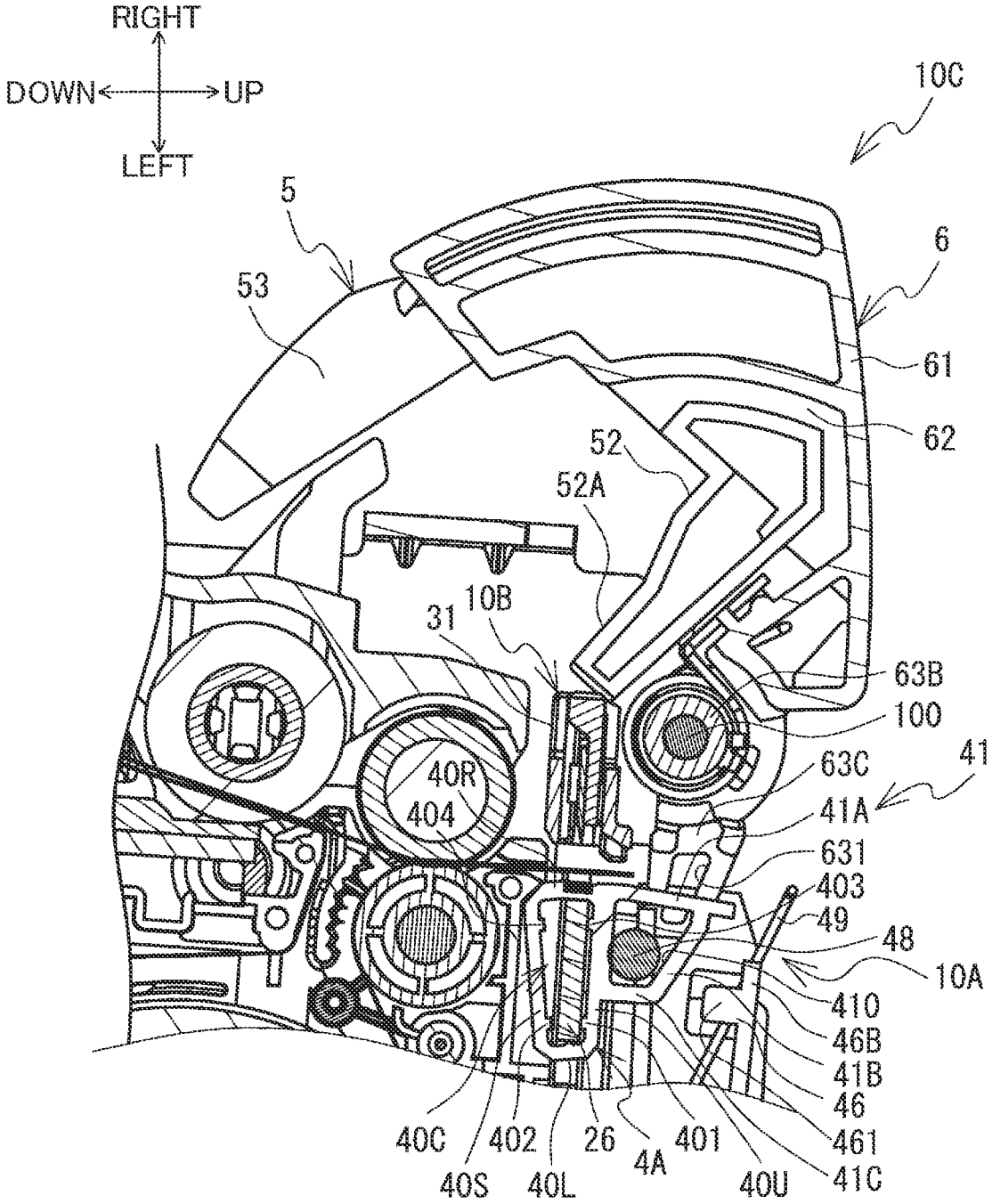
FIG. 13 is a cross-sectional view illustrating a portion of the printing device.
Figure 14:
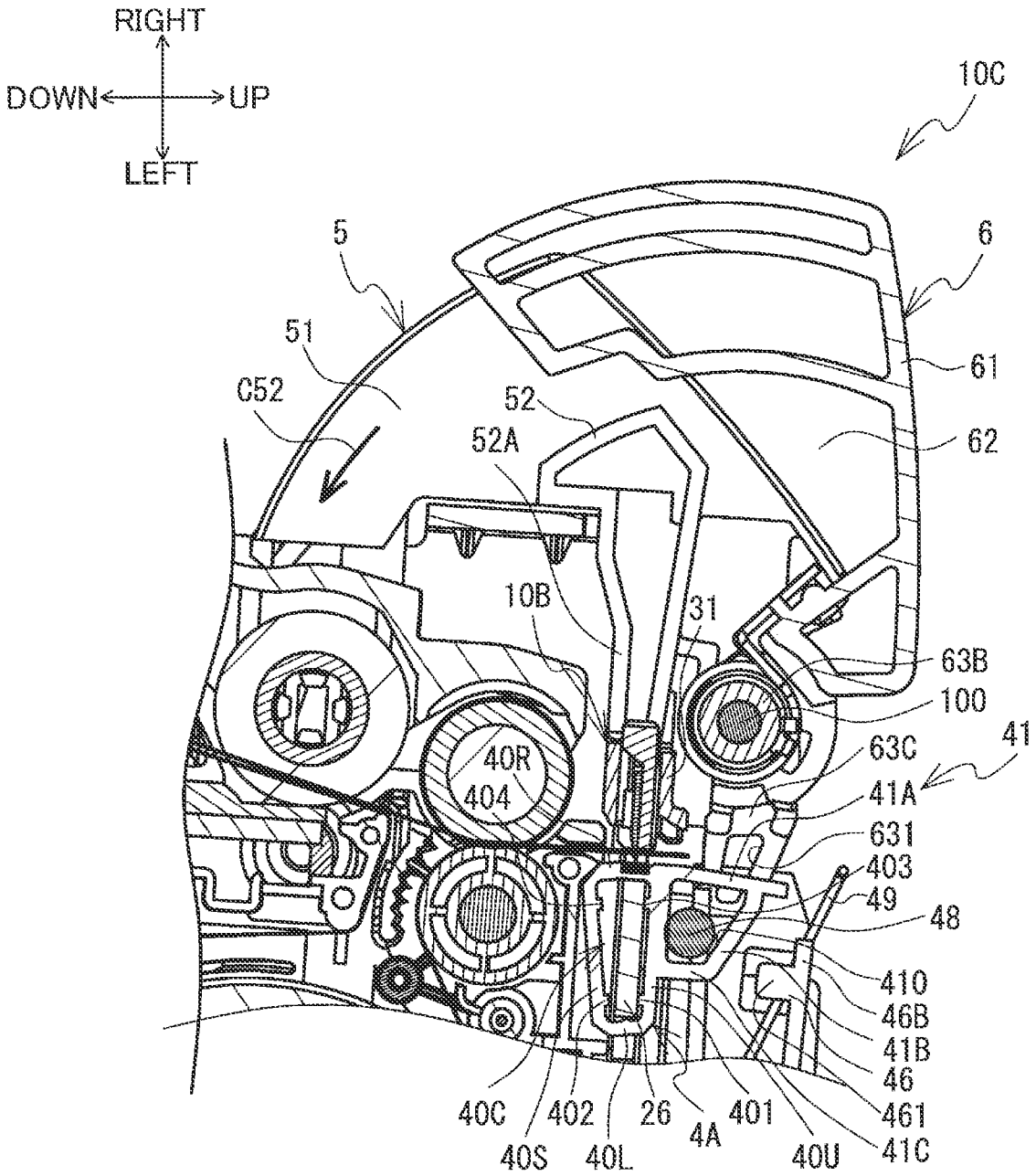
FIG. 14 is another cross-sectional view illustrating the portion of the printing device.
Figure 15:
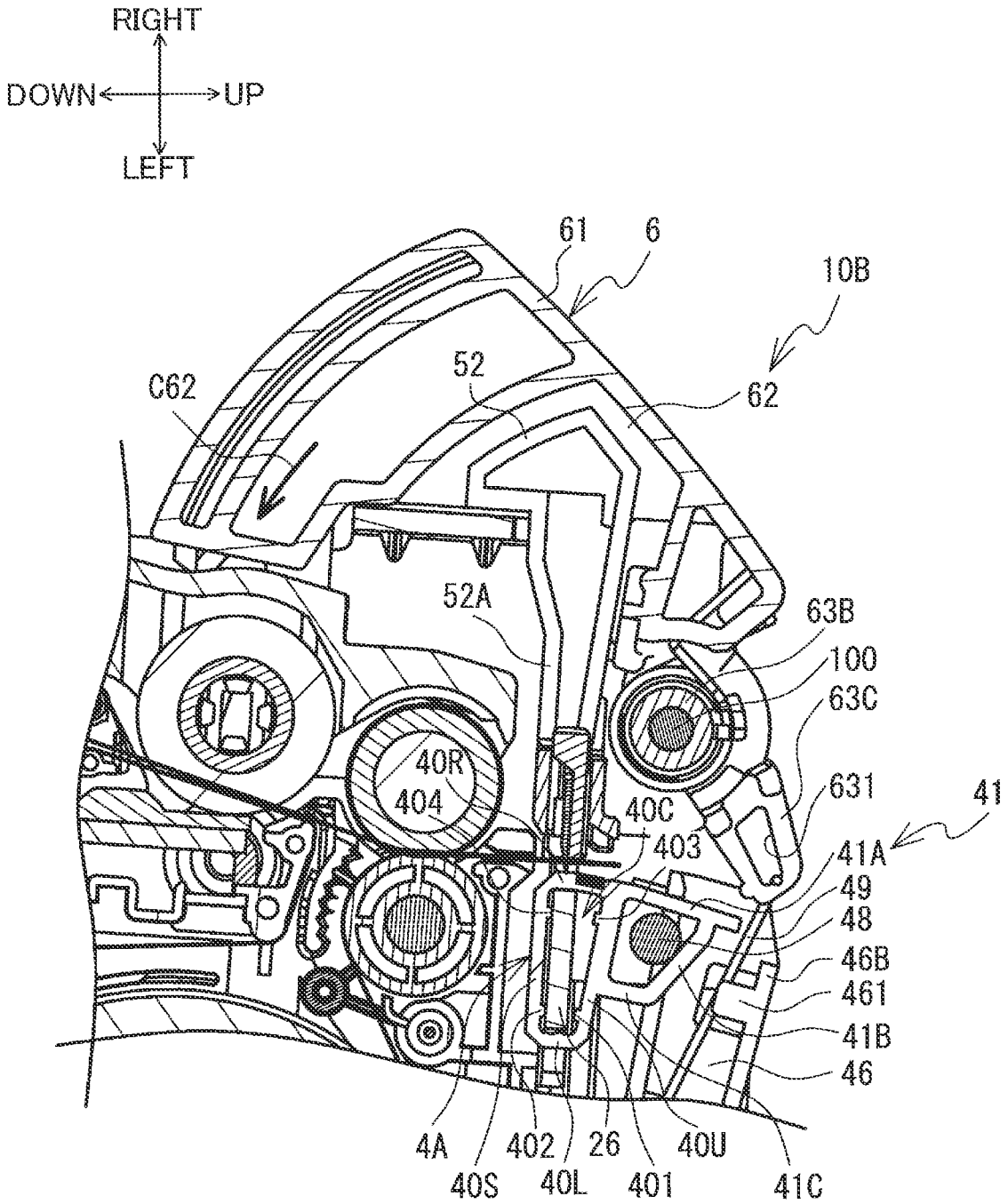
FIG. 15 is a cross-sectional view illustrating the portion of the printing device.

The upper wall 40U extends perpendicularly to the up-down direction. The lower wall 40S is inclined relative to an imaginary plane perpendicular to the up-down direction. A gap between the upper wall 40U and the lower wall 40S is gradually increased as these walls extend rightward as illustrated in FIGS. 13 through 15. The cutter cradle 4A has a front end formed with a front opening 40A (see FIG. 12) that opens frontward. The front opening 40A is in communication with an internal space 40C (see FIGS. 13 through 15) defined by the walls 40U, 40S, 40B, 40R, and 40L.

A support portion 26 (see FIG. 12) having a plate-like shape is provided in the cassette receiving portion 2 of the housing 1A. The support portion 26 extends rearward from a bottom surface (a front inner surface) of the cassette receiving portion 2, and extends perpendicularly to the up-down direction. The cutter cradle 4A is movably supported by the support portion 26.

Specifically, the support portion 26 is inserted into the internal space 40C of the cutter cradle 4A through the front opening 40A so that the cutter cradle 4A is disposed over the support portion 26. The support portion 26 is positioned opposite the cutter holder 32 with respect to the right wall 40R. The support portion 26 has a length in the left-right direction approximately equal to that of the internal space 40C defined by the right and left walls 40R and 40L of the cutter cradle 4A (see FIGS. 13 through 15).

The cutter cradle 4A is attachable to and detachable from the support portion 26. For example, the user can replace the cutter cradle 4A attached to the support portion 26 with a new cutter cradle 4A after the cutter cradle 4A has been deteriorated due to use of the printing device 1.

As illustrated in FIGS. 13 through 15, the cutter cradle 4A further includes a first protrusion 401, a second protrusion 402, a third protrusion 403, and a fourth protrusion 404. The first protrusion 401 protrudes inward of the internal space 40C from a left end portion of the upper wall 40U. The second protrusion 402 protrudes inward of the internal space 40C from a left end portion of the lower wall 40S. A gap in the up-down direction between the first protrusion 401 and the second protrusion 402 is approximately equal to a thickness of the support portion 26 (i.e., a length in the up-down direction of the support portion 26). The first protrusion 401 and the second protrusion 402 nip a left end portion of the support portion 26 positioned within the internal space 40C in cooperation with each other in the up-down direction.

The third protrusion 403 protrudes inward of the internal space 40C from a right end portion of the upper wall 40U. The fourth protrusion 404 protrudes inward of the internal space 40C from a right end portion of the lower wall 40S. A gap in the up-down direction between the third protrusion 403 and the fourth protrusion 404 is greater than the thickness of the support portion 26.

As illustrated in FIGS. 13 and 14, a right end portion of the cutter cradle 4A is movable downward until the third protrusion 403 abuts against an upper surface of the support portion 26. Further, as illustrated in FIG. 15, the right end portion of the cutter cradle 4A is movable upward until the fourth protrusion 404 abuts against a lower surface of the support portion 26. Accordingly, the cutter cradle 4A is pivotally movable in the up-down direction about the left end portion of the cutter cradle 4A that nips the support portion 26 with the first and second protrusions 401 and 402.

FIGS. 13 and 14 illustrate "half-cutting position" of the cutter cradle 4A where the third protrusion 403 abut against the support portion 26 to place the cutter cradle 4A at a most pivotally moved position in the counterclockwise direction as viewed from the rear side of the cutter cradle 4A. On the other hand, FIG. 15 illustrates "full-cutting position" of the cutter cradle 4A where the cutter cradle 4A is at a most pivotally moved position in the clockwise direction as viewed from the read side thereof as a result of abutment of the fourth protrusion 404 against the support portion 26. Accordingly, the cutter cradle 4A is pivotally movable between the half-cutting position and the full-cutting position.

As illustrated in FIGS. 12 through 15, a contact portion 41 is provided on the upper wall 40U. The contact portion 41 includes a first contact part 41A, a second contact part 41B, and a third contact part 41C those having a plate-like shape. The first contact part 41A has a surface extending perpendicularly to the left-right direction and extends upward from the right end portion of the upper wall 40U. The first contact part 41A has a length in the front-rear direction approximately half a length in the front-rear direction of the upper wall 40U.

The second contact part 41B extends diagonally leftward and downward from an upper end portion of a left surface of the first contact part 41A. The second contact part 41B has a length in the front-rear direction approximately one-third of the length in the front-rear direction of the first contact part 41A.

The third contact part 41C extends downward from a left end portion of the second contact part 41B, and is connected to the upper wall 40U. The third contact part 41C has a length in the front-rear direction equal to the length in the front-rear direction of the second contact part 41B. A portion surrounded by the first contact part 41A, the second contact part 41B, and the third contact part 41C will be referred to as "insertion portion 410". The upper wall 40U, the first contact part 41A, the second contact part 41B, and the third contact part 41C have centers in the front-rear direction coincident with each other. Hence, the contact portion 41 is positioned at a center in the up-down direction of the cutter cradle 4A.

As illustrated in FIG. 4, the right wall 40R of the cutter cradle 4A includes a first part 421 and a second part 422. The first part 421 and the second part 422 are portions configured to nip the cut target 99 in cooperation with the cutter blade 30. The first part 421 and the second part 422 are positioned offset from each other in the up-down direction. Specifically, the first part 421 is positioned downward of the second part 422.

The first part 421 and the second part 422 have lengths in the front-rear direction equal to each other, and equal to a length TAO of the cutter cradle 4A in the front-rear direction. As illustrated in FIGS. 8 and 10, the length L40 of the cutter cradle 4A is smaller than a length L30 in the front-rear direction of the cutter blade 30.

In either cases where the cutter cradle 4A is positioned at the half-cutting position (see FIG. 8) or where the cutter cradle 4A is positioned at the full-cutting position (see FIG. 10), a front end portion of the cutter blade 30 is positioned further frontward than the front end of the cutter cradle 4A, and a rear end portion of the cutter blade 30 is positioned further rearward than the rear end of the cutter cradle 4A. That is, the front end portion and the rear end portion of the cutter blade 30 are positioned further outward than the front end and the rear end of the cutter cradle 4A, respectively, both when the cutter cradle 4A is positioned at the half-cutting position and when the cutter cradle 4A is positioned at the full-cutting position.

The first part 421 is made from resin, and has a flat surface. The second part 422 is made from metal, and includes a flat surface part 422A and a pair of protruding parts 422B. The flat surface part 422A has a flat surface. The pair of protruding parts 422B are provided at respective ends in the front-rear direction of the flat surface part 422A to protrude further rightward than the flat surface part 422A. The pair of protruding parts 422B are positioned away from each other so that the flat surface part 422A is positioned between the protruding parts 422B in the front-rear direction.

A protruding length in the left-right direction of each of the protruding parts 422B relative to the flat surface part 422A is approximately 50 μm. A minimum distance in the front-rear direction between the protruding parts 422B is greater than the length in the front-rear direction of the cut target 99, i.e., the widthwise length of the cut target 99.

A shaft 27 extending in the up-down direction is fixed to an interior portion of the housing 1A, and the pivot member 4B is pivotally movably supported by the shaft 27 as illustrated in FIGS. 4 through 7. The pivot member 4B includes a base portion 46, a tubular portion 47, a holding member 48, and a spring 49.

The base portion 46 functions to support both the tubular portion 47 and the holding member 48 those will be described later. The base portion 46 includes a base plate 460, a first abutment plate 46A, and a second abutment plate 46B as particularly illustrated in FIGS. 5 and 6. The base plate 460 extends perpendicular to the front-rear direction, and is positioned further frontward than the cutter cradle 4A.

The first abutment plate 46A and the second abutment plate 46B extend rearward from a rear surface of the base plate 460, and also extend perpendicularly to the up-down direction. The first abutment plate 46A is provided on a lower end portion of the base plate 460, and extends in the left-right direction over an entire length in the left-right direction of the base plate 460. The first abutment plate 46A is positioned further upward than the upper wall 40U of the cutter cradle 4A.

The second abutment plate 46B is provided on an upper end portion of the base plate 460, and extends rightward from a left end of the base plate 460. The second abutment plate 46B has a right end portion provided with a hook 461.

The tubular portion 47 is provided on the left end portion of the base portion 46, and extends rearward from the rear surface of the base plate 460. The shaft 27 is inserted through a hole formed in the base plate 460 and an interior space of the tubular portion 47. With this configuration, the pivot member 4B is pivotally movable about the shaft 27.

The spring 49 is a torsion spring having a coil portion disposed over the tubular portion 47 and one end portion held by the hook 461 of the base portion 46. The spring 49 urges the pivot member 4B in a clockwise direction as viewed from the rear side of the pivot member 4B. An urging force of the spring 49 is smaller than the urging force of the cradle lever spring (not illustrated) that urges the cutter cradle lever 6 in the clockwise direction C61.

The holding member 48 has a substantially solid cylindrical shape, and extends rearward from the base plate 460 of the base portion 46. During a process of the attachment of the cutter cradle 4A to the support portion 26, the cutter cradle 4A is moved frontward relative to the holding member 48 so that the holding member 48 is inserted into the insertion portion 410 surrounded by the first contact part 41A, the second contact part 41B, the third contact part 41C, and the upper wall 40U from a front side of the insertion portion 410. The holding member 48 makes contact with a part of an inner wall of the insertion portion 410.

Incidentally, the contact portion 41 is positioned at the center in the up-down direction of the cutter cradle 4A as described above. Hence, the contact portion 41 makes contact with the holding member 48 at the center in the front-rear direction of the cutter cradle 4A.

Figure 9:
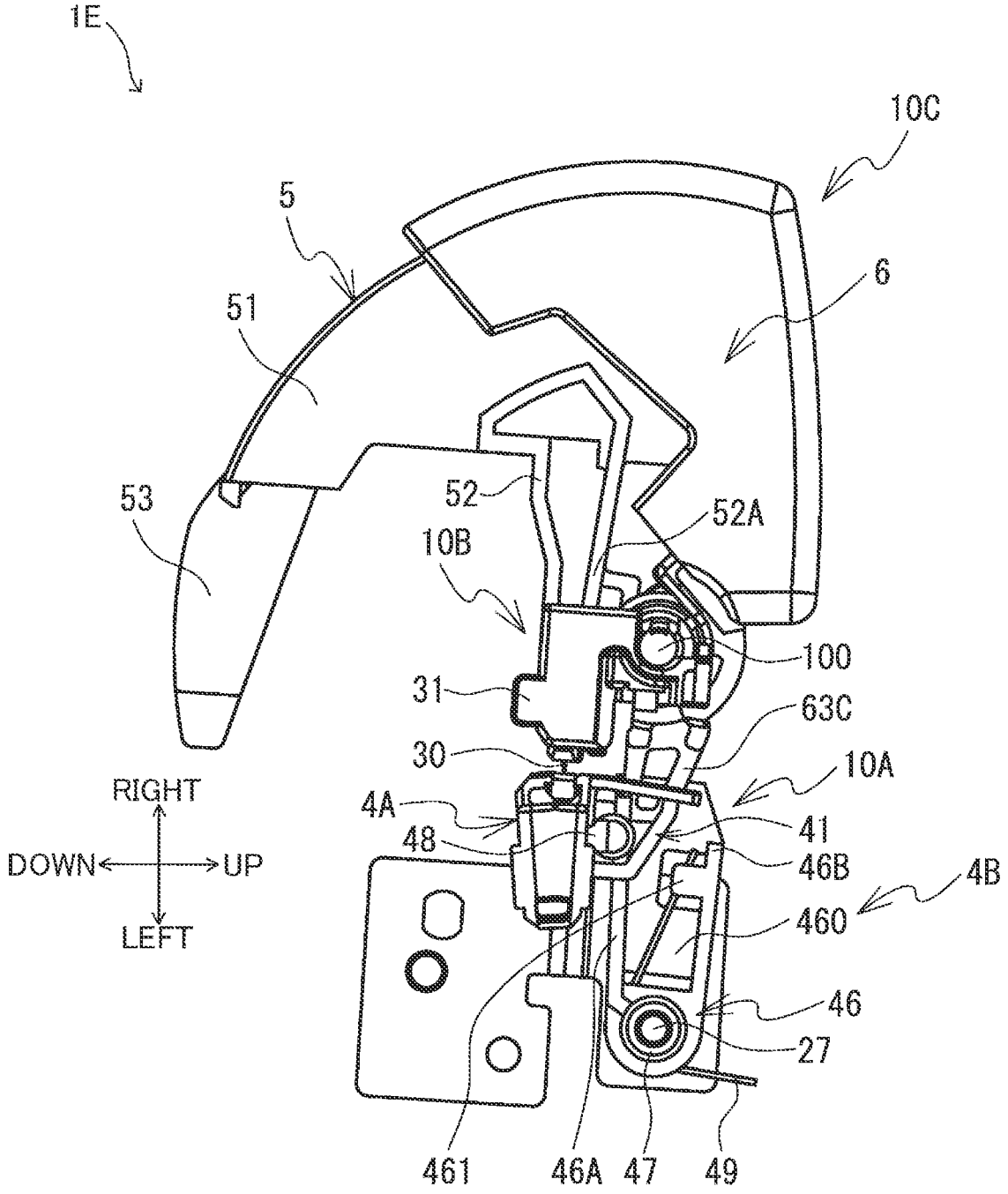
FIG. 9 is a rear side view of the cutting device.

As illustrated in FIGS. 6 and 9, in a state where the cutter cradle lever 6 is positioned at the full-cutting standby position, the left end portion of the arm portion 63C of the cutter cradle lever 6 is positioned upward of and in abutment against an upper surface of the first abutment plate 46A. With this abutment of the arm portion 63C against the first abutment plate 46A, the pivotal movement of the pivot member 4B in the clockwise direction because of the urging force of the spring 49 is restrained.

In this state, the holding member 48 is in contact with the upper wall 40U and the contact portion 41 of the cutter cradle 4A and presses the cutter cradle 4A downward. At the same time, as illustrated in FIGS. 13 and 14, the third protrusion 403 is pressed against the support portion 26, whereby the cutter cradle 4A is positioned at the half-cutting position. Further, in this state, the second part 422 of the cutter cradle 4A is positioned leftward of the cutter blade 30 and faces the cutter blade 30 as illustrated in FIGS. 4 and 8.

Figure 11:
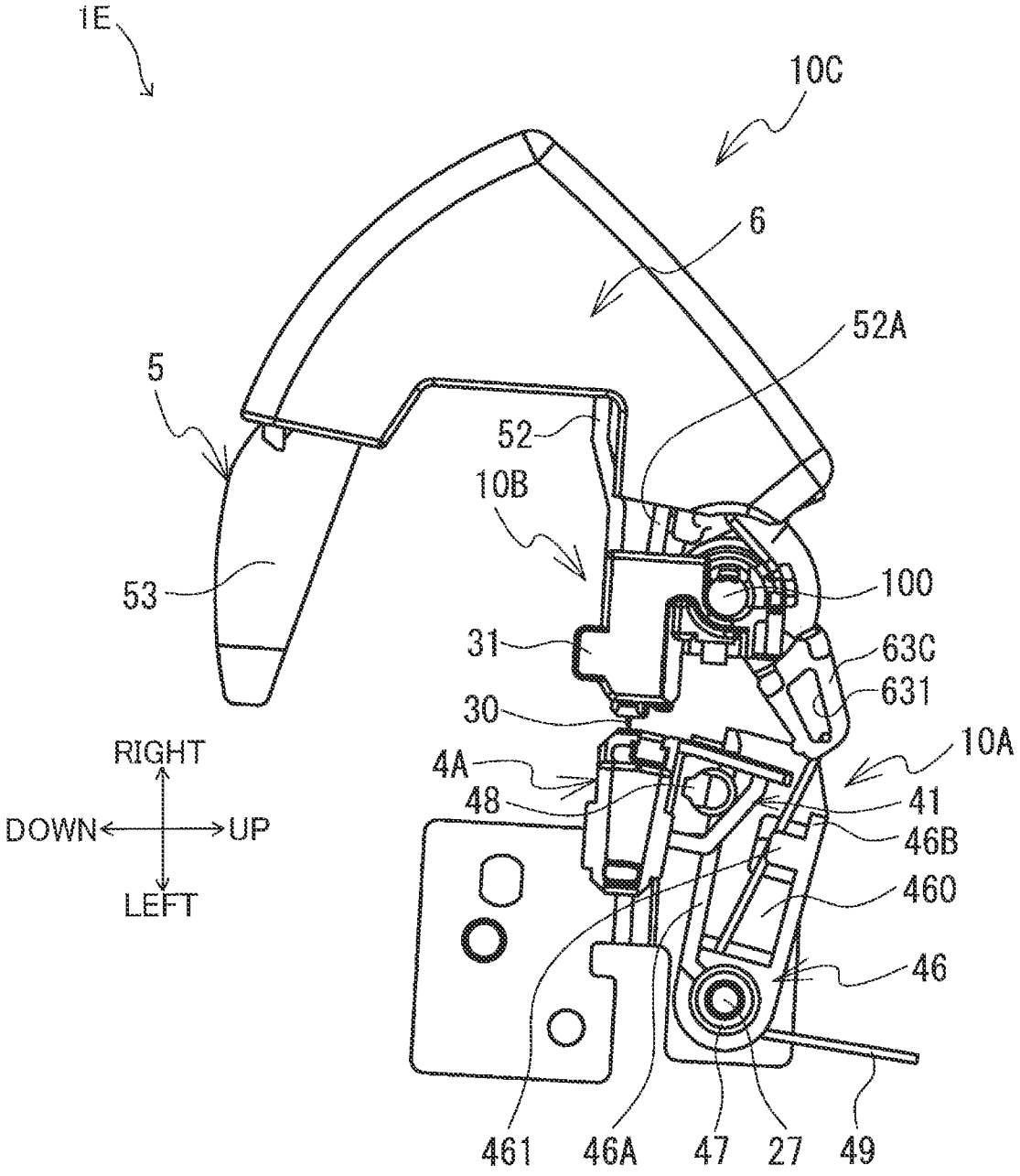
FIG. 11 is a rear side view of the cutting device.

On the other hand, in the process of the movement of the cutter cradle lever 6 from the full-cutting standby position to the full-cutting operation position, the left end portion of the arm portion 63C of the extending portion 63 is moved upward so that the arm portion 63C is separated away from the first abutment plate 46A as illustrated in FIG. 11. As the arm portion 63C is separated upward, the pivot member 4B is pivotally moved in the clockwise direction by the urging force of the spring 49 to cause the holding member 48 to be moved upward in accordance with the pivotal movement of the pivot member 4B.

Accordingly, the contact portion 41 of the cutter cradle 4A receives an pressing force directed upward and applied from the holding member 48 so that the cutter cradle 4A is pivotally moved until the fourth protrusion 404 is brought into abutment against the support portion 26. As a result, the cutter cradle 4A is moved to the full-cutting position from the half-cutting position. Further, as illustrated in FIG. 10, in a state where the cutter cradle 4A is at the full-cutting position, the first part 421 of the cutter cradle 4A is positioned leftward of the cutter blade 30 and faces the cutter blade 30.

Figure 16:
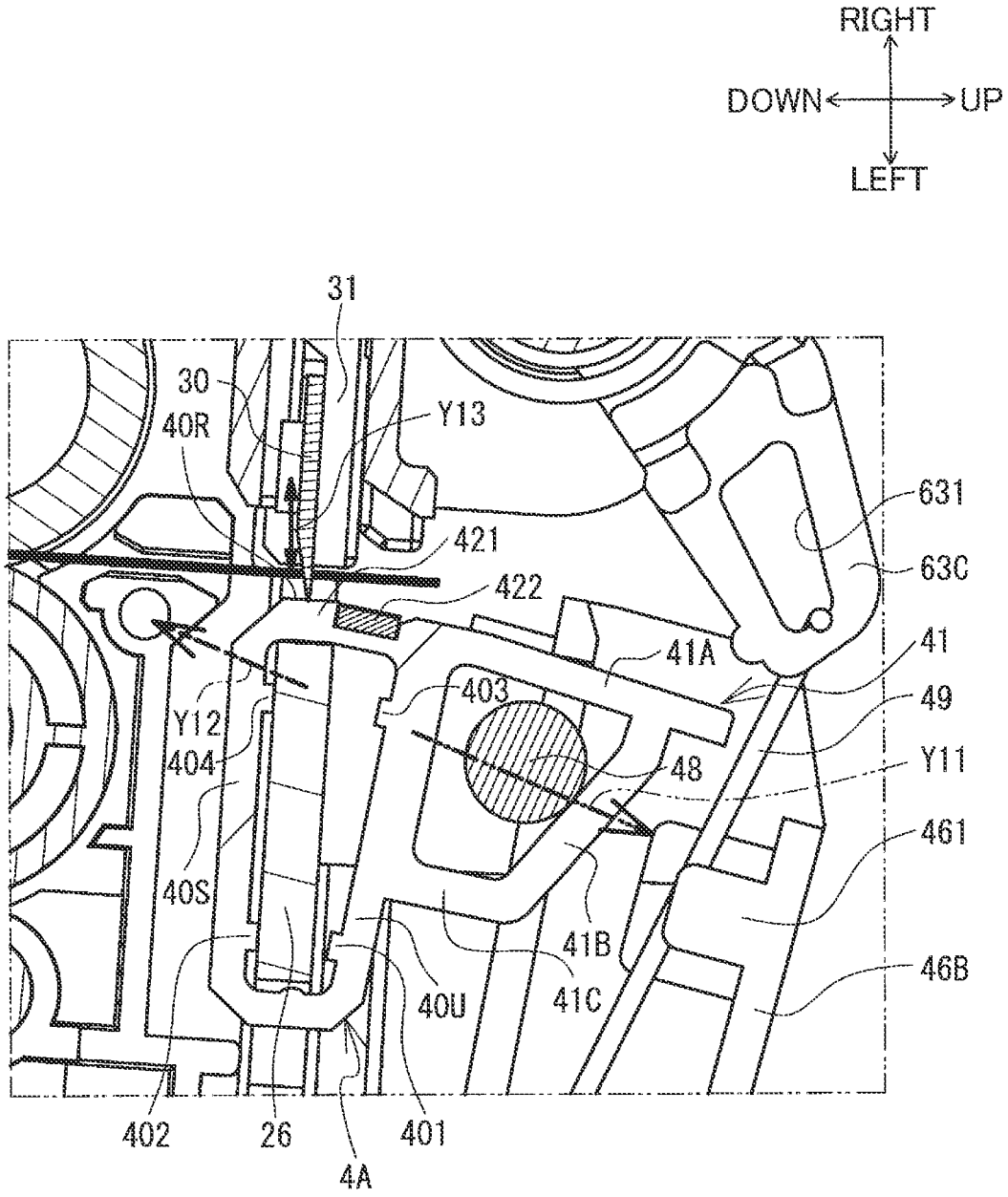
FIG. 16 is an enlarged cross-sectional view illustrating a portion of FIG. 15.

A moving direction in which the cutter cradle 4A is moved from the half-cutting position to the full-cutting position will be referred to as "first moving direction Y11" as illustrated in FIG. 16. In this case, the support portion 26 is relatively moved with respect to the cutter cradle 4A in "second moving direction Y12" opposite the first moving direction Y11. Further, a moving direction in which the cutter blade 30 is moved together with the movement of the cutter holder 32 will be referred to as a "cutter blade moving direction Y13".

The first moving direction Y11 is a direction directed diagonally leftward and upward. The second moving direction Y12 is a direction directed diagonally rightward and downward. The cutter blade moving direction Y13 is coincident with the left-right direction. That is, both the first moving direction Y11 and the second moving direction Y12 cross the cutter blade moving direction Y13. Further, during the movement of the cutter cradle 4A from the half-cutting position to the full-cutting position in the first moving direction Y11, the support portion 26 is relatively moved in the second moving direction Y12 with respect to the cutter cradle 4A so that a right-lower corner portion of the support portion 26 is pressed against the right wall 40R and the lower wall 40S of the cutter cradle 4A.

Figure 17:
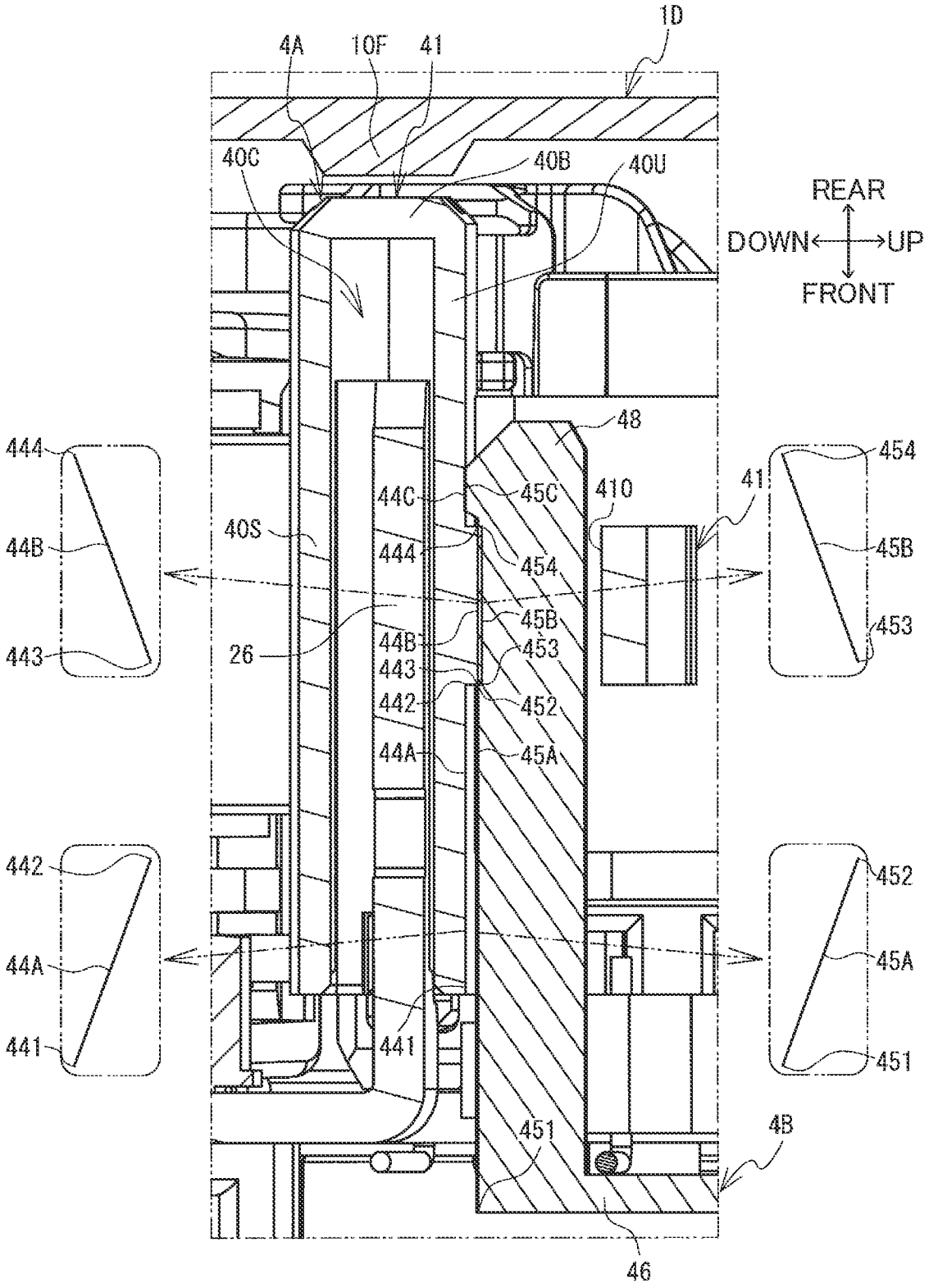
FIG. 17 is a cross-sectional view taken along a line XVII-XVII of FIG. 3 as viewed in a direction indicated by arrows in FIG. 3.

As illustrated in FIG. 17, in a state where the holding member 48 is inserted into the insertion portion 410, the upper wall 40U of the cutter cradle 4A is positioned downward of the holding member 48 to face the same. The upper wall 40U includes a first sloped portion 44A, a first load portion 44B, and a first contact portion 44C.

Of the upper wall 40U, the first sloped portion 44A is a portion positioned frontward of the insertion portion 410, the first contact portion 44C constitutes a portion positioned rearward of the insertion portion 410, and the first load portion 44B is positioned rearward of the first sloped portion 44A and frontward of the first contact portion 44C. The first load portion 44B is aligned with and constitutes the insertion portion 410. That is, the first sloped portion 44A, the first load portion 44B, and the first contact portion 44C are arranged in this order in the rearward direction.

The first sloped portion 44A is sloped relative to the front-rear direction. As illustrated in FIG. 17 in detail, the first sloped portion 44A has a front end 441, and a rear end 442 adjacent to the first load portion 44B. The first sloped portion 44A is inclined diagonally frontward and downward as extending away from the rear end 442 to the front end 441. In other words, the first sloped portion 44A is inclined frontward such that the front end 441 is positioned further downward than the rear end 442.

The first sloped portion 44A and the holding member 48 are always spaced apart from each other in the up-down direction regardless of the relative position between the cutter cradle 4A and the holding member 48. With this configuration, a load is not imparted from the holding member 48 on the first sloped portion 44A even when the holding member 48 is moved.

The first load portion 44B protrudes upward so that the first load portion 44B is positioned further upward than the first sloped portion 44A. The first load portion 44B makes contact with a second load portion 45B (described later) of the holding member 48 in the state where the cutter cradle 4A is at the half-cutting position. The first load portion 44B directly receives a load from the holding member 48 to retain the cutter cradle 4A at the half-cutting position.

The first load portion 44B has a front end 443 adjacent to the first sloped portion 44A, and a rear end 444 adjacent to the first contact portion 44C. The first load portion 44B is inclined diagonally rearward and downward as extending away from the front end 443 to the rear end 444. In other words, the first load portion 44B is inclined rearward such that the rear end 444 is positioned further downward than the front end 443.

The first contact portion 44C is positioned further downward than the first load portion 44B, and makes contact with a second contact portion 45C (described later) of the holding member 48 from below.

The holding member 48 includes a second sloped portion 45A, the second load portion 45B, and the second contact portion 45C, those are portions positioned upward of the cutter cradle 4A to face the same in the state where the holding member 48 is inserted into the insertion portion 410.

Of the holding member 48, the second sloped portion 45A is a portion positioned frontward of the insertion portion 410, the second contact portion 45C constitutes a portion positioned rearward of the insertion portion 410, and the second load portion 45B is positioned rearward of the second sloped portion 45A and frontward of the second contact portion 45C. The second load portion 45B is aligned with the insertion portion 410 in the up-down direction, and is positioned inside the insertion portion 410. That is, the second sloped portion 45A, the second load portion 45B, and the second contact portion 45C are arranged in this order in the rearward direction.

The second sloped portion 45A has a portion positioned upward of the first sloped portion 44A and face the first sloped portion 44A. The second sloped portion 45A is inclined relative to the front-rear direction. Specifically, the second sloped portion 45A has a front end 451, and a rear end 452 adjacent to the second load portion 45B. The second sloped portion 45A is inclined diagonally frontward and downward as extending from the rear end 452 to the front end 451. In other words, the second sloped portion 45A is sloped frontward such that the front end 451 is positioned further downward than the rear end 452.

The second sloped portion 45A and the first sloped portion 44A of the cutter cradle 4A are always spaced apart from each other in the up-down direction regardless of the relative position between the cutter cradle 4A and the holding member 48. Accordingly, the second sloped portion 45A does not apply a load to the cutter cradle 4A even when the holding member 48 is moved.

The second load portion 45B makes contact with the first load portion 44B of the cutter cradle 4A in the state where the cutter cradle 4A is at the half-cutting position. The second load portion 45B directly applies a load to the cutter cradle 4A to retain the cutter cradle 4A at the half-cutting position.

The second load portion 45B has a front end 453 adjacent to the second sloped portion 45A, and a rear end 454 adjacent to the second contact portion 45C. The second load portion 45B is inclined diagonally rearward and downward as extending from the front end 453 to the rear end 454. In other words, the second load portion 45B is inclined rearward such that the rear end 454 is positioned further downward than the front end 453.

The second contact portion 45C protrudes downward to be positioned further downward than the second load portion 45B, and makes contact with the first contact portion 44C of the cutter cradle 4A from above.

The cover 1D has an inner surface (i.e., a front surface) provided with a protruding portion 10F. The protruding portion 10F protrudes frontward toward the cutter cradle 4A attached to the support portion 26 in a state where the cover 1D closes the cassette receiving portion 2. The protruding portion 10F is configured to prevent unintentional detachment of the cutter cradle 4A from the support portion 26 of the cassette receiving portion 2. The protruding portion 10F has a protruding end (i.e., a front end) positioned away from the cutter cradle 4A in the front-rear direction to form a gap between the protruding portion 10F and the cutter cradle 4A.

[Printing Operation]

Next, a printing operation performed in the printing device 1 according to the first embodiment will be described. In a state where the cover 1D opens the cassette receiving portion 2 (a state illustrated in FIG. 2), the platen holder 23 is at the remote position. Upon attachment of the cassette 9 to the cassette receiving portion 2 by the user, the ribbon take-up shaft 22B is inserted into the ribbon take-up spool 96D, and at the same time, the tape drive shaft 22A is inserted into the tape drive roller 91, and the head holder 21 is inserted into the head opening 94A. In this state, a width direction of each of the transparent film tape 99A, the ink ribbon 99C, and the double-sided adhesive tape 99B is parallel to the front-rear direction.

Then, the platen holder 23 is pivotally moved from the remote position to the proximity position in accordance with a closing movement of the cover 1D. As a result, the platen roller 23B presses the ink ribbon 99C and the transparent film tape 99A those are superimposed against the printing head 21A. The conveying roller 23C presses the double-sided adhesive tape 99B and the transparent film tape 99A those are superimposed against the tape drive roller 91.

In response to input of print instructions by the user to the operating portion 1B, the drive motor is driven to rotate the tape drive shaft 22A, the platen roller 23B, and the ribbon take-up shaft 22B. The tape drive roller 91 is rotated together with rotation of the tape drive shaft 22A, and the conveying roller 23C is rotated following rotation of the tape drive roller 91. Hence, the double-sided adhesive tape 99B, the transparent film tape 99A, and the ink ribbon 99C are conveyed in the printing device 1.

Specifically, the double-sided adhesive tape 99B is paid out from the second tape roll 97B, the transparent film tape 99A is paid out from the first tape roll 97A, and the ink ribbon 99C is paid out from the ribbon roll 97C. The transparent film tape 99A and the ink ribbon 99C are ejected through the first tape guide 95A and conveyed toward the printing position due to the rotation of the drive motor.

In the printing device 1, the printing head 21A generates heat to allow ink contained in the ink ribbon 99C to be transferred to the transparent film tape 99A, whereby a character(s) is printed on the transparent film tape 99A at the printing position. The transparent film tape 99A and the used ink ribbon 99C are conveyed toward the second tape guide 95B by rotation of the platen roller 23B and the ribbon take-up shaft 22B.

The ink contained in the ink ribbon 99C is released from the ink ribbon 99C as the ink ribbon 99C is separated from the transparent film tape 99A at the separating position. The used ink ribbon 99C that has moved past the separating position is taken up by rotation of the ribbon take-up shaft 22B as the ribbon take-up roll 97D. The printed transparent film tape 99A that has moved past the separating position is directed to the second tape guide 95B by the rotation of the conveying roller 23C and the tape drive roller 91.

At a position between the tape drive roller 91 and the conveying roller 23C, one surface of the double-sided adhesive tape 99B and the transparent film tape 99A that has moved past the second tape guide 95B are bonded together to provide the cut target 99. The provided cut target 99 is conveyed toward the ejecting portion 93. The cut target 99 moved past the ejecting portion 93 passes through the cutting device 1E, and is discharged toward an upper portion of the housing 1A. Then, the drive motor and the printing head 21A are halted and the printing operation is terminated. A subsequent printing operation can be repeatedly performed in this way when the user inputs new print instructions through the operating portion 1B.

[Half-Cutting Operation]

How the half-cutting operation is performed in the cutting device 1E will next be described. The half-cutting operation is performed, for example, each time a printing operation is performed. In order to perform the half-cutting operation, the user operates only the cutter lever 5 to cause the cutter lever 5 to be moved in the direction indicated by the arrow C52 from the half-cutting standby position (see FIGS. 4 and 6) to the half-cutting operation position (see FIGS. 8 and 9) against the urging force of the cutter lever spring (not illustrated).

Through this operation, the entry portion 52A of the cutter lever 5 enters the notched hole 31A of the box member 31 of the cutter portion 10B to be brought into contact with the cutter holder 32, thereby moving the cutter holder 32 against the urging force of the cutter spring (not illustrated). In accordance with the movement of the cutter holder 32, the cutter blade 30 is also moved leftward from the retracted position (see FIG. 4) to the cutting position (see FIG. 8).

Note that, when only the cutter lever 5 is operated by the user, the cutter cradle lever 6 is not moved and maintained at its full-cutting standby position. Accordingly, the cutter cradle 4A is maintained at the half-cutting position as illustrated in FIG. 14. In this state, the second part 422 of the cutter cradle 4A faces the cutter blade 30 at the position leftward of the cutter blade 30 as illustrated in FIGS. 8 and 14.

The cutter blade 30 moved together with the cutter holder 32 nips the cut target 99 in cooperation with the second part 422. The cutter blade 30 presses the cut target 99 leftward and is brought into contact with the pair of protruding parts 422B of the second part 422. Since the cutting edge of the cutter blade 30 cannot reach the flat surface part 422A of the second part 422, the cut target 99 is partially cut in a thickness direction thereof. As such, the half-cutting operation is performed with respect to the cut target 99 by the cooperation of the cutter blade 30 with the second part 422 of the cutter cradle 4A.

After completion of the half-cutting operation with respect to the cut target 99, the user releases operation to the cutter lever 5 to allow the cutter lever 5 to be moved back in the direction indicated by the arrow C51 (see FIG. 4) from the half-cutting operation position to the half-cutting standby position due to the urging force of the cutter lever spring. The entry portion 52A of the cutter lever 5 is moved out of the notched hole 31A of the box member 31 of the cutter portion 10B. Hence, the cutter holder 32 is moved by the urging force of the cutter spring to move the cutter blade 30 rightward from the cutting position (see FIG. 8) to the retracted position (see FIG. 4). The cutter blade 30 is thus accommodated in the box member 31.

[Full-Cutting Operation]

A process of the full-cutting operation will be described next. The full-cutting operation is performed, for example, after a printing operation and a half-cutting operation corresponding thereto are repeatedly performed. For performing the full-cutting operation, only the cutter cradle lever 6 is operated by the user to cause cutter cradle lever 6 to be moved in the direction indicated by the arrow C62 from the full-cutting standby position (see FIGS. 4 to 9) to the full-cutting operation position (see FIGS. 10 and 11) against the urging force of the cutter cradle lever spring (not illustrated).

In accordance with the movement of the cutter cradle lever 6, the pivot member 4B is also pivotally moved due to the urging force of the spring 49. A load is imparted on the cutter cradle 4A in response to the movement of the holding member 48, whereby the cutter cradle 4A is moved from the half-cutting position (see FIG. 13) to the full-cutting position (see FIG. 15). That is, the cutter cradle lever 6 makes contact with the cutter cradle 4A indirectly through the pivot member 4B for moving the cutter cradle 4A from the half-cutting position to the full-cutting position. At the full-cutting position of the cutter cradle 4A, the first part 421 of the cutter cradle 4A faces the cutter blade 30 of the cutter holder 32 at the position leftward of the cutter blade 30.

Further, in accordance with the movement of the cutter cradle lever 6, the contacting portion 62 of the cutter cradle lever 6 is brought into contact with the protruding portion 52 of the cutter lever 5 to move the cutter lever 5 from the half-cutting standby position to the half-cutting operation position against the urging force of the cutter lever spring. That is, the cutter lever 5 is moved in interlocking relation to the cutter cradle lever 6 by the interlocking portion 10D due to the user operation only to the cutter cradle lever 6.

At this time, the protruding portion 52 of the cutter lever 5 enters the notched hole 31A of the box member 31 of the cutter portion 10B to move the cutter holder 32. Hence, the cutter holder 32 moves the cutter blade 30 leftward from the retracted position (see FIG. 4) to the cutting position (see FIG. 10).

The cutter blade 30 that has been moved together with the cutter holder 32 nips the cut target 99 in cooperation with the first part 421 of the cutter cradle 4A. The cutting edge of the cutter blade 30 presses the cut target 99 leftward, and is brought into contact with the first part 421. Since the cutting edge reaches the first part 421, the cut target 99 is completely cut in a thickness direction thereof and is divided into two parts. The full-cutting operation with respect to the cut target 99 is performed in this way by the cooperation of the cutter blade 30 with the first part 421 of the cutter cradle 4A.

The user operation to the cutter cradle lever 6 is released after termination of the full-cutting operation to the cut target 99. The cutter cradle lever 6 is moved back in the direction indicated by the arrow C61 (see FIG. 4) from the full-cutting operation position to the full-cutting standby position due to the urging force of the cutter cradle lever spring. Further, in accordance with the movement of the cutter cradle lever 6, the pivot member 4B is pivotally moved back against the urging force of the spring 49 to cause the cutter cradle 4A to be moved from the full-cutting position (see FIG. 15) to the half-cutting position (see FIG. 13).

Further, in accordance with the movement of the cutter cradle lever 6 to the full-cutting standby position, the contacting portion 62 of the cutter cradle lever 6 separates from the protruding portion 52 of the cutter lever 5. As a result, the cutter lever 5 is also moved back by the urging force of the cutter lever spring from the half-cutting operation position to the half-cutting standby position to cause the entry portion 52A of the cutter lever 5 to come out of the notched hole 31A of the box member 31 of the cutter portion 10B. Hence, the cutter holder 32 is moved rightward by the urging force of the cutter spring to move the cutter blade 30 rightward from the cutting position (see FIG. 10) to the retracted position (see FIG. 4). The cutter blade 30 is thus accommodated in the box member 31.

Second Embodiment

[Overview of Cutting Device 1F]

A cutting device 1F according to a second embodiment of the present disclosure will be described with reference to FIGS. 18 through 20D wherein like parts and components are designated by the same reference numerals as those shown in the first embodiment to avoid duplicating description.

The cutting device 1F is provided in the printing device 1 instead of the cutting device 1E described above. A fundamental configuration of the cutting device 1F and the operation thereof are substantially the same as those of the cutting device 1E. A configuration of the cutting device 1F and its attendant operation those different from the cutting device 1E will be described.

Figure 18:
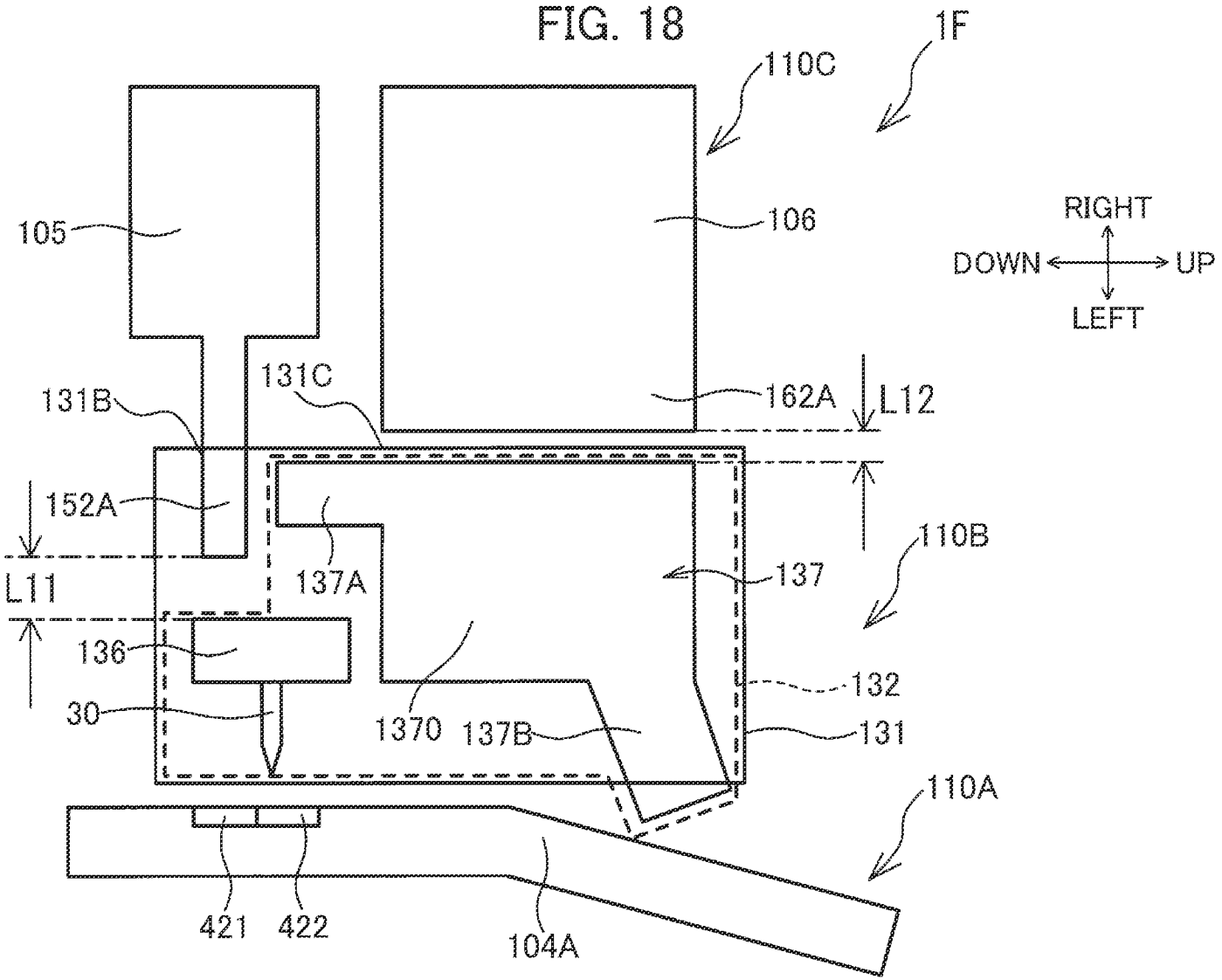
FIG. 18 is a schematic diagram of a cutting device.

As illustrated in FIG. 18, the cutting device 1F includes a lever portion 10C including a cutter lever 105 and a cutter cradle lever 106, but not includes a configuration corresponding to the interlocking portion 10D (see FIG. 4) provided in the cutting device 1E of the first embodiment. Accordingly, the cutter lever 105 and the cutter cradle lever 106 are movable independently from each other. Further, the cutter cradle lever 106 includes an entry portion 162A similarly to the cutter lever 105 including an entry portion 152A. A box member 131 of a cutter portion 110B is formed with a first hole 131B and a second hole 131C.

FIG. 18 illustrates a state where the cutter lever 105 is positioned at its half-cutting standby position, and the cutter cradle lever 106 is positioned at its full-cutting standby position. The entry portion 152A of the cutter lever 105 is configured to enter the box member 131 through the first hole 131B in accordance with movement of the cutter lever 105 from the half-cutting standby position to the half-cutting operation position due to the user operation. Also, the entry portion 162A of the cutter cradle lever 106 is configured to enter the box member 131 through the second hole 131C in accordance with movement of the cutter cradle lever 106 from the full-cutting standby position to the full-cutting operation position due to the user operation.

A cutter holder 132 of the cutter portion 110B includes a first cutter holder 136 and a second cutter holder 137. The first cutter holder 136 directly supports the cutter blade 30. As the entry portion 152A of the cutter lever 105 enters the first hole 131B of the box member 131 to press the first cutter holder 136 leftward, the first cutter holder 136 causes the cutter blade 30 to be moved from the retracted position to the cutting position. That is, the cutter lever 105 makes contact with the cutter blade 30 indirectly through the first cutter holder 136 to move the cutter blade 30.

The second cutter holder 137 includes a base portion 1370, an abutment portion 137A, and an arm portion 137B. The abutment portion 137A and the arm portion 137B are provided on the base portion 1370. The base portion 1370 is movable as the entry portion 162A of the cutter cradle lever 106 enters the box member 131 through the second hole 131C and contacts the base portion 1370.

The abutment portion 137A is brought into abutment against the first cutter holder 136 (see FIG. 20C) in accordance with the movement of the base portion 1370, thereby moving the cutter blade 30 from the retracted position toward the cutting position through the first cutter holder 136. That is, the cutter cradle lever 106 makes contact with the cutter blade 30 indirectly through the first cutter holder 136 and the second cutter holder 137 to move the cutter blade 30.

The arm portion 137B functions the same as the pivot member 4B in the cutting device 1E according to the first embodiment. That is, the arm portion 137B is configured to abut against a cutter cradle 104A in accordance with the movement of the base portion 1370 to move the cutter cradle 104A from its half-cutting position to its full-cutting position. That is, the cutter cradle lever 106 makes contact with the cutter cradle 104A indirectly through the second cutter holder 137 to move the cutter cradle 104A.

In the present embodiment, a member corresponding to the pivot member 4B (see FIG. 6) of the cutting device 1E is dispensed with, and a cradle portion 110A only includes the cutter cradle 104A. In a state where the cutter cradle 104A is positioned at the half-cutting position, the second part 422 of the cutter cradle 104A faces the cutter blade 30 at a position leftward of the cutter blade 30. In a state where the cutter cradle 104A is positioned at the full-cutting position, the first part 421 of the cutter cradle 104A faces the cutter blade 30 at a position leftward of the cutter blade 30.

Hereinafter, a distance between the first cutter holder 136 and the entry portion 152A of the cutter lever 105 positioned at the half-cutting standby position will be referred to as "first distance L11". Specifically, the first distance L11 is a distance in a moving direction in which the entry portion 152A is moved (i.e., the left-right direction) between a portion of the entry portion 152A which makes contact with the first cutter holder 136 and a portion of the first cutter holder 136 which makes contact with the entry portion 152A.

That is, the first distance L11 corresponds to a distance by which the entry portion 152A is moved in a case where the cutter lever 105 is moved from the half-cutting standby position toward the half-cutting operation position until the entry portion 152A is brought into contact with the first cutter holder 136.

Further, a distance between the second cutter holder 137 and the entry portion 162A of the cutter cradle lever 106 positioned at the full-cutting standby position will be referred to as "second distance L12". Specifically, the second distance L12 is a distance in a moving direction in which the entry portion 162A is moved (i.e., the left-right direction) between a portion of the entry portion 162A which makes contact with the second cutter holder 137 and a portion of the second cutter holder 137 which makes contact with the entry portion 162A.

That is, the second distance L12 corresponds to a distance by which the entry portion 162A is moved in accordance with the movement of the cutter cradle lever 106 from the full-cutting standby position toward the full-cutting operation position until the entry portion 162A is brought into contact with the second cutter holder 137. The first distance L11 is greater than the second distance L12.

[Half-Cutting Operation]

Figure 19A:
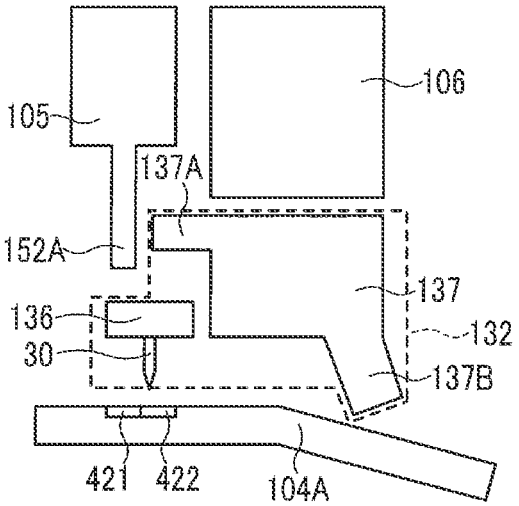
FIG. 19A is a schematic diagram of the cutting device.

A half-cutting operation with respect to the cut target 99 performed by the user operation to the cutter lever 105 will be described with reference to FIGS. 19A through 19C. In order to perform the half-cutting operation, only the cutter lever 105 is operated by the user to be moved from the half-cutting standby position illustrated in FIG. 19A to the half-cutting operation position illustrated in FIG. 19C against the urging force of the cutter lever spring (not illustrated).

Figure 19B:
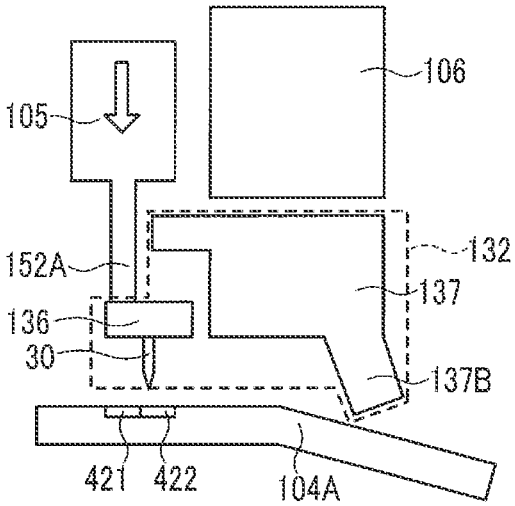
FIG. 19B is a schematic diagram of the cutting device.

During this process of the movement of the cutter lever 105, the entry portion 152A of the cutter lever 105 enters the first hole 131B (see FIG. 18) of the box member 131 of the cutter portion 110B and is brought into contact with the first cutter holder 136 as illustrated in FIG. 19B. As the cutter lever 105 is further moved, the first cutter holder 136 is pressed to be moved in accordance with the movement of the entry portion 152A to move the cutter blade 30 leftward from the retracted position (see FIG. 19B) to the cutting position (see FIG. 19C). Hence, the moved cutter blade 30 and the second part 422 of the cutter cradle 104A nip the cut target 99 therebetween, thereby performing the half-cutting operation to cut the cut target 99 in cooperation with each other.

Figure 19C:
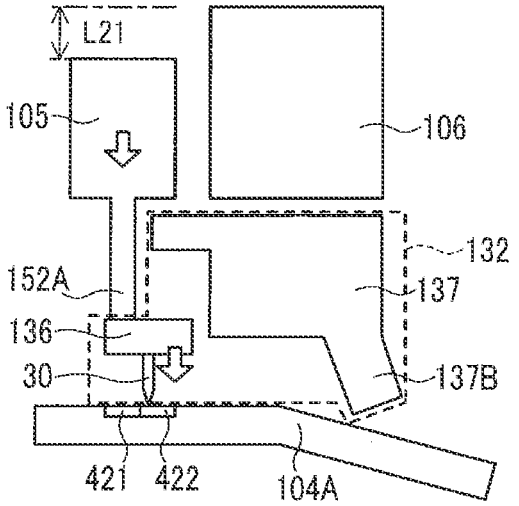
FIG. 19C is a schematic diagram of the cutting device.

A first moving amount L21 illustrated in FIG. 19C is indicative of an amount (a distance) of movement by which the cutter lever 105 is moved from the half-cutting standby position to the half-cutting operation position. Further, the movement of the cutter lever 105 from the half-cutting standby position to the half-cutting operation position takes a first time period t11 when a predetermined pressing force is applied to the cutter lever 105 by the user.

[Full-Cutting Operation]

A full-cutting operation with respect to the cut target 99 performed by user operation to the cutter cradle lever 106 will be described with reference to FIGS. 20A through 20D. When the full-cutting operation is performed, only the cutter cradle lever 106 is operated by the user. The cutter cradle lever 106 is moved from the full-cutting standby position illustrated in FIG. 20A to the full-cutting operation position illustrated in FIG. 20D against the urging force of the cutter cradle lever spring (not illustrated).

Figure 20A:
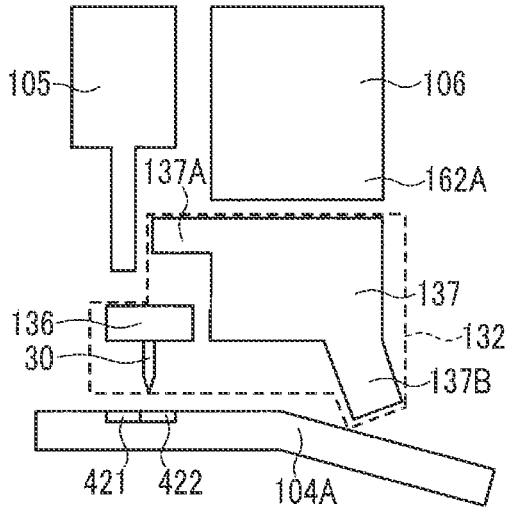
FIG. 20A is a schematic diagram of the cutting device.
Figure 20B:
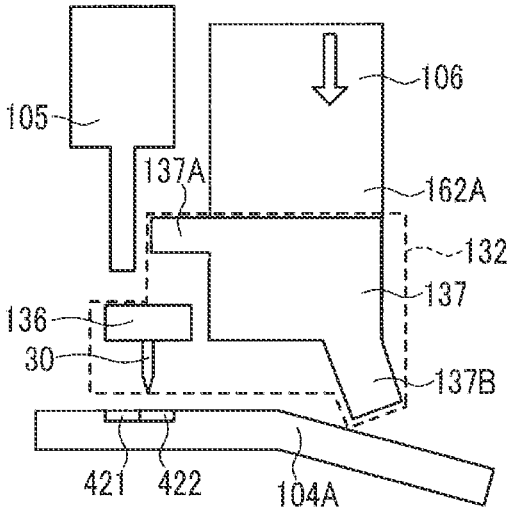
FIG. 20B is a schematic diagram of the cutting device.
Figure 20C:
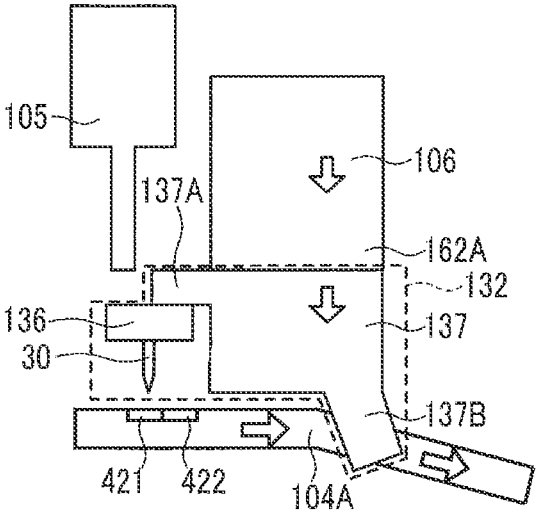
FIG. 20C is a schematic diagram of the cutting device.

During the movement of the cutter cradle lever 106, the entry portion 162A of the cutter cradle lever 106 enters the second hole 131C (see FIG. 18) of the box member 131 of the cutter portion 110B and contacts to press the second cutter holder 137 leftward as illustrated in FIG. 20B. When the cutter cradle lever 106 is further moved as illustrated in FIG. 20C, the second cutter holder 137 is moved to cause the arm portion 137B of the second cutter holder 137 to be brought into abutment against the cutter cradle 104A, so that the cutter cradle 104A is moved upward from the half-cutting position (see FIG. 20B) to the full-cutting position (see FIG. 20C). As such, the first part 421 of the cutter cradle 104A faces the cutter blade 30 at a position leftward of the cutter blade 30.

A timing at which the movement of the cutter cradle 104A to the full-cutting position from the half-cutting position is completed will be referred to as "cutter cradle movement completion timing E11".

Figure 20D:
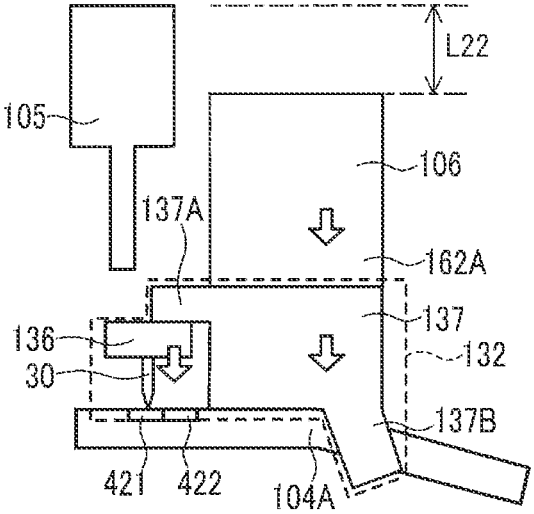
FIG. 20D is a schematic diagram of the cutting device.

At the same time, the abutment portion 137A of the second cutter holder 137 is brought into abutment against the first cutter holder 136 due to the leftward movement of the second cutter holder 137 so that the first cutter holder 136 is moved by the abutment portion 137A to move the cutter blade 30 leftward from the retracted position (see FIG. 20C) to the cutting position (see FIG. 20D).

A timing at which the movement of the cutter blade 30 from the retracted position to the cutting position is completed will be referred to as "cutter blade movement completion timing E12". Here, the cutter cradle movement completion timing E11 is earlier than the cutter blade movement completion timing E12. Accordingly, the cut target 99 is securely nipped between the cutter blade 30 and the first part 421. The full-cutting operation is performed with respect to the cut target 99 by the cooperation between the cutter blade 30 and the cutter cradle 104A in this way.

A second moving amount L22 shown in FIG. 20D is indicative of an amount (a distance) of movement of the cutter cradle lever 106 from the full-cutting standby position to the full-cutting operation position. The second moving amount L22 by which the cutter cradle lever 6 is moved during the full-cutting operation is greater than the first moving amount L21 (see FIG. 19C) by which the cutter lever 105 is moved during the half-cutting operation from the half-cutting standby position to the half-cutting operation position.

Further, the movement of the cutter cradle lever 106 from the full-cutting standby position to the full-cutting operation position takes a second time period t12 in a case where a predetermined pressing force is applied to the cutter cradle lever 106 by the user.

Assuming that the cutter lever 105 and the cutter cradle lever 106 are operated by the user under the same condition (i.e., in a case where the same predetermined pressing force is applied to each of the cutter lever 105 and the cutter cradle lever 106), the second time period t12 which is a period of time required for the cutter cradle lever 106 to be moved from the full-cutting standby position to the full-cutting operation position in the full-cutting operation is greater than the first time period t11, i.e., the period of time required for the cutter lever 5 to be moved from the half-cutting standby position to the half-cutting operation position in the half-cutting operation.

Third Embodiment

[Overview of Cutting Device 1G]

A cutting device 1G according to a third embodiment of the present disclosure will be described with reference to FIGS. 21 through 23C wherein like parts and components are designated by the same reference numerals as those shown in the first and second embodiments to avoid duplicating description.

The cutting device 1G is provided in the printing device 1 instead of the cutting device 1E or the cutting device 1F described above. The cutting device 1G has a configuration and performs operations fundamentally the same as those of the cutting devices 1E and 1F. A configuration and operations in the cutting device 1G those different from the cutting devices 1E and 1F will be mainly described.

Figure 21:
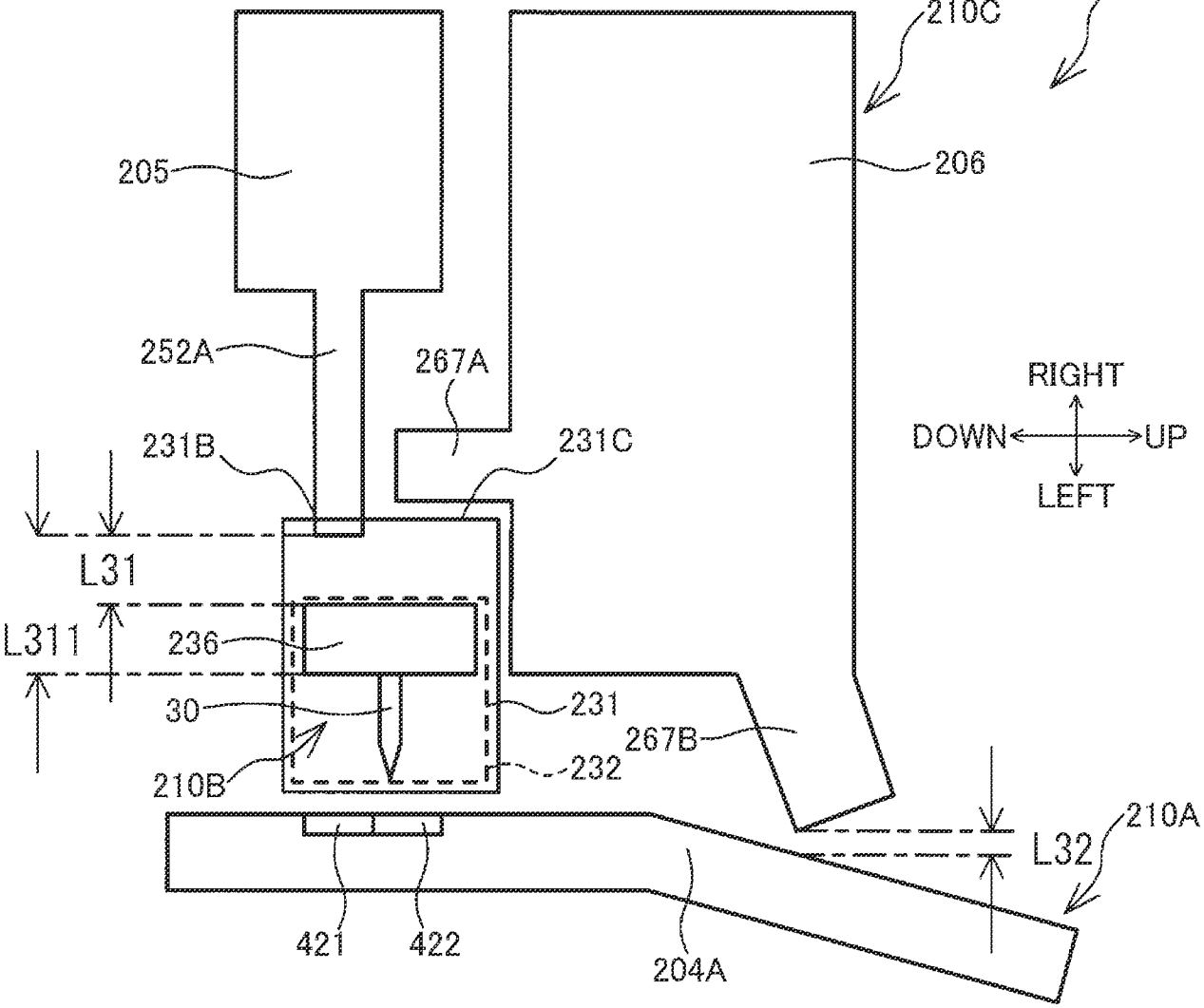
FIG. 21 is a schematic diagram of a cutting device.

As illustrated in FIG. 21, the cutting device 1G includes a lever portion 210C including a cutter lever 205 and a cutter cradle lever 206. However, the lever portion 210C does not include a component corresponding to the interlocking portion 10D (see FIG. 4) provided in the cutting device 1E according to the first embodiment. Hence, the cutter lever 205 and the cutter cradle lever 206 are movable independently of each other.

Further, the cutter cradle lever 206 includes an entry portion 267A and an arm portion 267B. The entry portion 267A and the arm portion 267B are components corresponding to the abutment portion 137A and the arm portion 137B provided in the second cutter holder 137 of the cutting device 1F according to the second embodiment, respectively. FIG. 21 illustrates a state where the cutter lever 205 is positioned at its half-cutting standby position, and the cutter cradle lever 206 is positioned at its full-cutting standby position.

The cutting device 1F also includes a cutter portion 210B including a box member 231. The box member 231 is formed with a first hole 231B and a second hole 231C. An entry portion 252A of the cutter lever 205 is configured to enter the box member 231 through the first hole 231B in accordance with movement of the cutter lever 205 from the half-cutting standby position to its half-cutting operation position due to the user operation (see FIG. 22C). The entry portion 267A of the cutter cradle lever 206 is configured to enter the box member 231 through the second hole 231C in accordance with the movement of the cutter cradle lever 206 from the full-cutting standby position to its full-cutting operation position due to the user operation (see FIG. 23C).

A cutter holder 232 of the cutter portion 210B is not provided with a member corresponding to the second cutter holder 137 (see FIG. 18) of the cutting device 1F in the second embodiment, but is provided with only a first cutter holder 236. The first cutter holder 236 directly supports the cutter blade 30. The first cutter holder 236 is configured to move the cutter blade 30 from the retracted position to the cutting position when the entry portion 252A of the cutter lever 205 enters the box member 231 through the first hole 231B and presses the first cutter holder 236 leftward. That is, the cutter lever 205 makes contact with the cutter blade 30 indirectly through the first cutter holder 236, thereby moving the cutter blade 30.

Further, the first cutter holder 236 is configured to move the cutter blade 30 from the retracted position to the cutting position when the entry portion 267A of the cutter cradle lever 206 enters the box member 231 through the second hole 231C to press the first cutter holder 236 leftward. That is, the cutter cradle lever 206 makes contact with the cutter blade 30 indirectly through the first cutter holder 236 for moving the cutter blade 30.

The arm portion 267B of the cutter cradle lever 206 functions the same as the pivot member 4B of the cutting device 1E according to the first embodiment. The arm portion 267B is configured to abut against a cutter cradle 204A of a cradle portion 210A in accordance with the movement of the cutter cradle lever 206, thereby moving the cutter cradle 204A from its half-cutting position to its full-cutting position. That is, the cutter cradle lever 206 makes contact with the cutter cradle 204A directly for moving the cutter cradle 204A.

As illustrated in FIG. 21, a distance between the first cutter holder 236 and the entry portion 252A of the cutter lever 205 positioned at the half-cutting standby position will be referred to as "first distance L31". Specifically, the first distance L31 is a distance in a moving direction by which the entry portion 252A is moved (i.e., the left-right direction) between a portion of the entry portion 252A which makes contact with the first cutter holder 236 and a portion of the first cutter holder 236 which makes contact with the portion of the entry portion 252A. That is, the first distance L31 corresponds to a distance by which the entry portion 252A is moved in a case where the cutter lever 205 is moved from the half-cutting standby position toward the half-cutting operation position until the entry portion 252A is brought into contact with the first cutter holder 236.

Further, a total length of the first distance L31 and a length of the first cutter holder 236 in the moving direction of the entry portion 252A (a length of the first cutter holder 236 in the left-right direction) will be referred to as "first distance L311". The first distance L311 corresponds to a distance between the cutter blade 30 and the entry portion 252A of the cutter lever 205 positioned at the half-cutting standby position.

As illustrated in FIG. 21, a distance between the cutter cradle 204A and the arm portion 267B of the cutter cradle lever 206 positioned at the full-cutting standby position will be referred to as "second distance L32". Specifically, the second distance L32 is a distance in a moving direction in which the arm portion 267B is moved (i.e., the left-right direction) between a portion of the arm portion 267B which makes contact with the cutter cradle 204A and a portion of the cutter cradle 204A which makes contact with the portion of the arm portion 267B.

That is, the second distance L32 corresponds to a distance by which the arm portion 267B is moved in a case where the cutter cradle lever 206 is moved from the full-cutting standby position toward the full-cutting operation position until the arm portion 267B is brought into contact with the cutter cradle 204A. The first distance L31 and the first distance 1311 are greater than the second distance L32.

[Half-Cutting Operation]

Figure 22A:
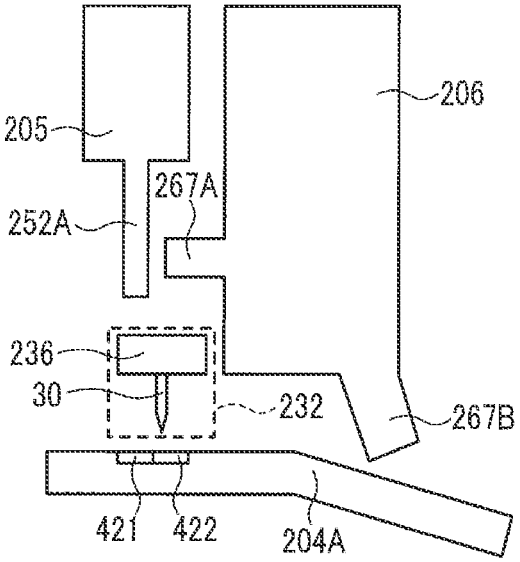
FIG. 22A is a schematic diagram of the cutting device.

Next, a half-cutting operation with respect to the cut target 99 performed by a user operation to the cutter lever 205 will be described with reference to FIGS. 22A through 22C. In order to perform the half-cutting operation, only the cutter lever 205 is operated by the user. The cutter lever 205 is thus moved from the half-cutting standby position illustrated in FIG. 22A to the half-cutting operation position illustrated in FIG. 22C against the urging force of the cutter lever spring (not illustrated).

Figure 22B:
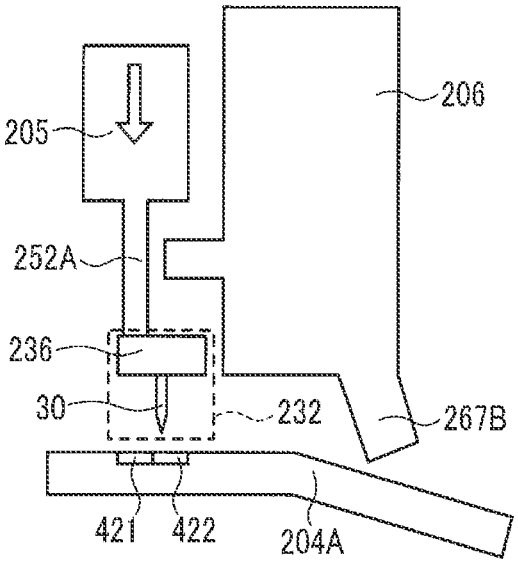
FIG. 22B is a schematic diagram of the cutting device.

During a process of the movement of the cutter lever 205, the entry portion 252A of the cutter lever 205 enters the box member 231 of the cutter portion 210B through the first hole 231B (see FIG. 21) to contact the first cutter holder 236 as illustrated in FIG. 22B. The first cutter holder 236 is pressed and moved by the movement of the entry portion 252A to move the cutter blade 30 leftward from the retracted position (FIGS. 22A and 22B) to the cutting position (FIG. 22C). Hence, the cutter blade 30 and the second part 422 of the cutter cradle 204A nip the cut target 99 therebetween. As a result, the half-cutting operation is performed with respect to the cut target 99 by the cooperation of the cutter blade 30 with the cutter cradle 204A.

Figure 22C:
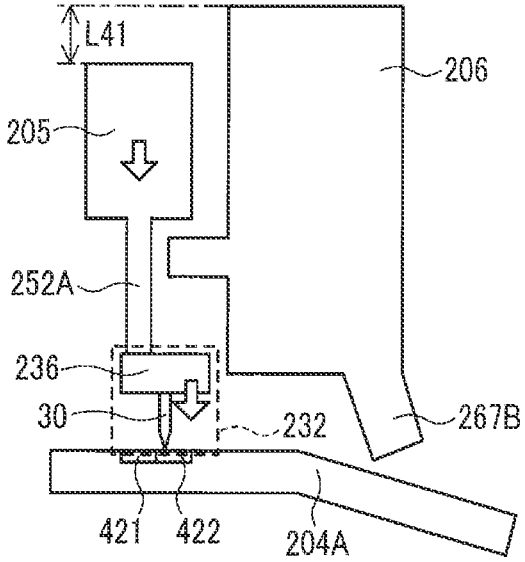
FIG. 22C is a schematic diagram of the cutting device.

A moving amount L41 illustrated in FIG. 22C is indicative of an amount (a distance) of the movement of the cutter lever 205 from the half-cutting standby position to the half-cutting operation position. Further, the movement of the cutter lever 205 from the half-cutting standby position to the half-cutting operation position takes a first time period t21 in a case where a predetermined pressing force is applied to the cutter lever 205 by the user.

[Full-Cutting Operation]

Figure 23A:
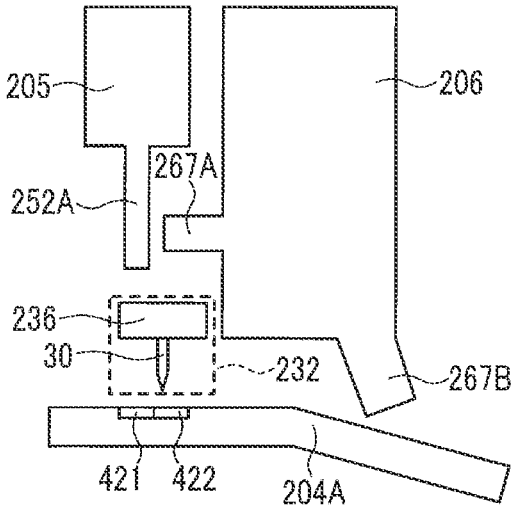
FIG. 23A is a schematic diagram of the cutting device.

Next, a full-cutting operation performed with respect to the cut target 99 by a user operation to the cutter cradle lever 206 will be described with reference to FIGS. 23A through 23C. When the full-cutting operation is performed, only the cutter cradle lever 206 is operated by the user to be moved from the full-cutting standby position illustrated in FIG. 23A to the full-cutting operation position illustrated in FIG. 23C against the urging force of the cutter cradle lever spring (not illustrated).

Figure 23B:
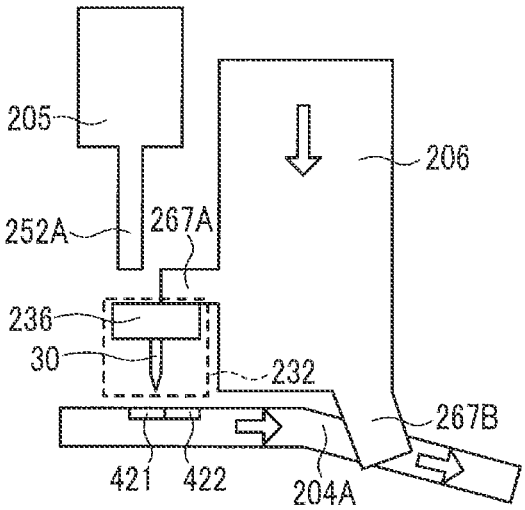
FIG. 23B is a schematic diagram of the cutting device.
Figure 23C:
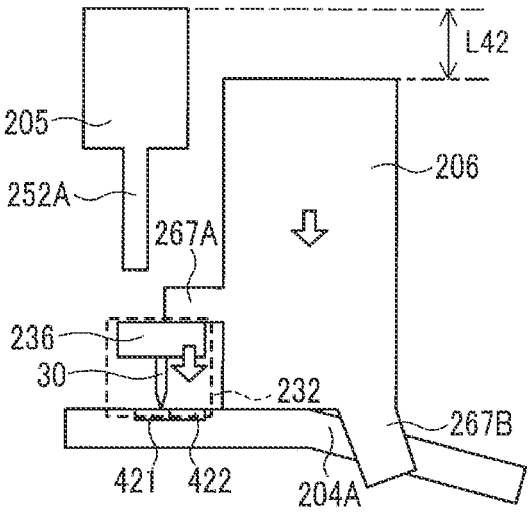
FIG. 23C is a schematic diagram of the cutting device.

During a process of the movement of the cutter cradle lever 206, the arm portion 267B of the cutter cradle lever 206 contacts and presses the cutter cradle 204A as illustrated in FIG. 23B, thereby moving the cutter cradle 104A from the half-cutting position (see FIG. 23A) to the full-cutting position (see FIG. 23C). Hence, the first part 421 of the cutter cradle 204A faces the cutter blade 30 at a position leftward of the cutter blade 30. A timing at which the movement of the cutter cradle 204A from the half-cutting position to the full-cutting position is completed will be referred to as "cutter cradle movement completion timing E21".

At the same time, the entry portion 267A of the cutter cradle lever 206 enters the box member 231 of the cutter portion 210B through the second hole 231C and contacts the first cutter holder 236 so that the first cutter holder 236 is moved by the entry portion 267A to move the cutter blade 30 leftward from the retracted position (FIGS. 23A and 23B) to the cutting position (see FIG. 23C). A timing at which the movement of the cutter blade 30 from the retracted position to the cutting position is completed will be referred to as "cutter blade movement completion timing E22".

Here, the cutter cradle movement completion timing E21 at which the movement of the cutter cradle 204A to the full-cutting position is completed is earlier than the cutter blade movement completion timing E22. Accordingly, the cut target 99 is securely nipped between the cutter blade 30 and the first part 421. In this way, the full-cutting operation is performed to the cut target 99 by the cooperation between the cutter blade 30 and the cutter cradle 104A.

A second moving amount L42 illustrated in FIG. 23C is indicative of an amount (a distance) by which the cutter cradle lever 206 is moved from the full-cutting standby position to the full-cutting operation position. The second moving amount L42 is greater than the first moving amount L41 (see FIG. 22C).

Further, the movement of the cutter cradle lever 206 from the full-cutting standby position to the full-cutting operation position takes a second time period t22 in a case where a predetermined pressing force is applied to the cutter cradle lever 206 by the user. In a case where the cutter lever 205 and the cutter cradle lever 206 are operated under the same condition (i.e., the predetermined pressing force is applied to each of the cutter lever 205 and the cutter cradle lever 206), the second time period t22 required for the cutter cradle lever 206 to be moved from the full-cutting standby position to the full-cutting operation position is greater than first time period t21 which is the period of time required for the cutter lever 205 to be moved from the half-cutting standby position to the half-cutting operation position.

Advantageous Effects in Embodiments

In the cutting devices 1E, 1F and 1G according to the first through third embodiments described above, the full-cutting operation or the half-cutting operation with respect to the cut target 99 is performed by the user operation to the cutter levers 5, 105 and 205, or the cutter cradle levers 6, 106 and 206. That is, the cutting operation can be performed in the cutting devices 1E, 1F and 1G without a motor for moving the cutter blade 30. Accordingly, a weight of the cutting devices 1E, 1F and 1G can be saved in comparison with a configuration where a motor is provided in the cutting device.

In the cutting device 1F, the second moving amount L22 of the cutter cradle lever 106 from the full-cutting standby position to the full-cutting operation position is greater than the first moving amount L21 of the cutter lever 105 from the half-cutting standby position to the half-cutting operation position. Similarly, in the cutting device 1G, the second moving amount L42 of the cutter cradle lever 206 from the full-cutting standby position to the full-cutting operation position is greater than the first moving amount L41 of the cutter lever 205 from the half-cutting standby position to the half-cutting operation position.

As a ground for these difference in the moving amounts, in the cutting devices 1F and 1G, the movement of the cutter lever 105 and 205 causes the movement of only the cutter blade 30, whereas the movement of the cutter cradle lever 106 and 206 causes the movement of not only the cutter blade 30 but also the cutter cradle 104A and 204A. By setting the second moving amount L22 greater than the first moving amount L21 in the cutting device 1F and by setting the second moving amount L42 greater than the first moving amount L41 in the cutting device 1G, the movement of the cutter blade 30 by the cutter lever 5 and 105, and the cutter cradle lever 106 and 206 can be attained while attaining the movement of the cutter cradle 104A and 204A by the cutter cradle lever 106 and 206.

In the cutting device 1F, in a case where the cutter lever 105 and the cutter cradle lever 106 are operated by the same predetermined pressing force, the second time period t12 required for the movement of the cutter cradle lever 106 from the full-cutting standby position to the full-cutting operation position is greater than the first time period t11 required for the movement of the cutter lever 105 from the half-cutting standby position to the half-cutting operation position.

Similarly, in the cutting device 1G, in a case where the cutter lever 205 and the cutter cradle lever 206 are operated by the same predetermined pressing force, the second time period t22 required for the movement of the cutter cradle lever 206 from the full-cutting standby position to the full-cutting operation position is greater than the first time period t21 required for the movement of the cutter lever 205 from the half-cutting standby position to the half-cutting operation position.

With the above configuration, the user can intuitively recognize that which one of the half-cutting operation and the full-cutting operation has been performed based on a period of time necessary for completing the operation.

In the cutting device 1F, the cutter cradle movement completion timing E11 at which the cutter cradle 104A has been completely moved from the half-cutting position to the full-cutting position by the user operation to the cutter cradle lever 106 is earlier than the cutter blade movement completion timing E12 at which the cutter blade 30 has been completely moved from the retracted position to the cutting position by the user operation to the cutter cradle lever 106.

Similarly, in the cutting device 1G, the cutter cradle movement completion timing E21 at which the cutter cradle 104A has been completely moved from the half-cutting position to the full-cutting position by the user operation to the cutter cradle lever 206 is earlier than the cutter blade movement completion timing E22 at which the cutter blade 30 has been completely moved from the retracted position to the cutting position by the user operation to the cutter cradle lever 206.

By virtue of the differences between the timing of completion of the movement of the cutter blade 30 and the timing of completion of the movement of the cutter cradle 104A and 204A, in the cutting devices 1F and 1G, the cut target 99 can be cut by the cutter blade 30 after completion of the movement of the cutter cradle 4A and 104A to the full-cutting position by the user operation to the cutter cradle lever 106 and 206. Accordingly, a mode for cutting the cut target 99 by the cutter blade 30 can be appropriately switched to a mode for performing the full-cutting operation from a mode for performing the half-cutting operation.

The cutter holder 132 of the cutting device 1F includes the first cutter holder 136 with which the cutter lever 105 makes contact and the second cutter holder 137 with which the cutter cradle lever 106 makes contact. Since the first cutter holder 136 contacting the cutter lever 105 and the second cutter holder 137 contacting the cutter cradle lever 106 are provided separately from each other in the cutter holder 132, a mechanical strength of the cutter holder 132 can be suitably maintained.

The cutting device 1F includes the second cutter holder 137 for moving the cutter cradle 104A. The second cutter holder 137 constitutes the cutter holder 132 in combination with the first cutter holder 136 holding the cutter blade 30. Since a component for moving the cutter cradle 104A need not be separately provided in the cutting device 1F, the configuration of the cutting device 1F can be simplified, whereby a downsizing, a weight saving, and a cost reduction of the cutting device 1F can be attained.

The cutting device 1G includes the cutter cradle lever 206 for moving the cutter cradle 204A, and a separate member for moving the cutter cradle 204A need not be provided. Accordingly, the configuration of the cutting device 1G can be simplified and thus a downsizing, a weight saving, and a cost reduction of the cutting device 1G can be achieved.

In the cutting device 1F, the first distance L11 between the cutter lever 105 at the half-cutting standby position and the first cutter holder 136 is greater than the second distance L12 between the cutter cradle lever 106 at the full-cutting standby position and the second cutter holder 137. Further, in the cutting device 1G, the first distance L311 between the cutter lever 205 at the half-cutting standby position to the cutter blade 30 is greater than the second distance L32 between the cutter cradle lever 206 at the full-cutting standby position and the cutter cradle 204A.

With such configurations of cutting devices 1F and 1G, the cutter cradle lever 106 and 206 can move the cutter cradle 104A and 204A, respectively, while moving the cutter blade 30 for performing the full-cutting operation with respect to the cut target 99, and the cutter lever 105 and 205 can move the cutter blade 30 for performing the half-cutting operation with respect to the cut target 99 without moving the cutter cradle 104A and 204A.

In the cutting device 1E, the first sloped portion 44A of the upper wall 40U of the cutter cradle 4A is inclined downward in the frontward direction as extending from the rear end 442 to the front end 441. Further, the second sloped portion 45A of the holding member 48 is inclined downward in the frontward direction as extending from the rear end 452 to the front end 451. With this configuration, the holding member 48 can be easily inserted into the insertion portion 410 of the cutter cradle 4A when the cutter cradle 4A is moved frontward during the attachment of the cutter cradle 4A to the support portion 26. Therefore, the process of the attachment of the cutter cradle 4A with respect to the support portion 26 can be facilitated.

In the cutting device 1E, the first load portion 44B of the upper wall 40U of the cutter cradle 4A is inclined downward in the rearward direction as extending from the front end 443 to the rear end 444. Further, the second load portion 45B of the holding member 48 is inclined downward in the rearward direction as extending from the front end 453 to the rear end 454.

With this configuration, a force directed in the frontward direction is applied to the cutter cradle 4A in the state where the holding member 48 presses against the upper wall 40U of the cutter cradle 4A from above. The force is directed in a direction opposite a direction in which the insertion portion 410 of the cutter cradle 4A is detached from the holding member 48, i.e., the rearward direction. Accordingly, unintentional detachment of the holding member 48 from the insertion portion 410 can be suppressed by virtue of the first load portion 44B and the second load portion 45B.

In a case where the first sloped portion 44A of the cutter cradle 4A and the second sloped portion 45A of the holding member 48 contacts each other and a load is applied from the holding member 48 to the cutter cradle 4A, a force directed in the rearward direction for releasing the holding member 48 from the insertion portion 410 may be applied to the cutter cradle 4A, which leads to an unfavorable situation (i.e., unintentional detachment of the holding member 48 from the insertion portion 410).

However, according to the printing device 1, the first sloped portion 44A and the second sloped portion 45A are constantly spaced apart from each other in the up-down direction regardless of the positional relationship between the cutter cradle 4A and the holding member 48. Accordingly, unintentional detachment of the holding member 48 from the insertion portion 410 can be restrained.

In the cutting device 1E, the first load portion 44B of the cutter cradle 4A and the second load portion 45B of the holding member 48 are in contact with each other in the state where the cutter cradle 4A is positioned at the half-cutting position. In this state, when a load is imparted from the holding member 48 on the cutter cradle 4A, a force directed in the frontward direction (i.e., a direction in which the insertion portion 410 is attached to the holding member 48) is applied to the cutter cradle 4A from the holding member 48, thereby ensuring insertion of the holding member 48 into the insertion portion 410. Accordingly, by virtue of the first load portion 44B and the second load portion 45B, the insertion portion 410 can be retrained from being released from the holding member 48.

In the cutting device 1E, the cover 1D includes the protruding portion 10F for preventing detachment of the cutter cradle 4A from the support portion 26. Further, the gap is formed between the protruding portion 10F and the cutter cradle 4A when the cover 1D closes the cassette receiving portion 2. Hence, the cutter cradle 4A can be smoothly moved between the half-cutting position and the full-cutting position without a mechanical interference between the cutter cradle 4A and the protruding portion 10F.

[Modifications]

While the description has been made in detail with reference to the specific embodiments, it would be apparent to those skilled in the art that the present disclosure is not limited to the above-described embodiments and various changes and modifications may be made thereto.

For example, the cutting devices 1E, 1F and 1G may not be provided in the printing device 1, but may be provided in another device in which a cut target 99 is to be cut. Further, the cutting devices 1E, 1F and 1G may not be provided in a device and may be an independent cutting device for cutting a cut target 99.

In the cutting devices 1E, 1F and 1G, the cutter levers 5, 105 and 205 may be configured to make contact directly with the cutter blade 30 in the process of the movement from the half-cutting standby position to the half-cutting operation position to move the cutter blade 30 from the retracted position to the cutting position. Further, the cutter cradle levers 6, 106 and 206 may be configured to make contact directly with the cutter blade 30 in the process of the movement from the full-cutting standby position to the full-cutting operation position to move the cutter blade 30 from the retracted position to the cutting position.

Further, the cutter cradle 4A, 104A and 204A may be positioned at the full-cutting position in a state where the cutter levers 5, 105 and 205 and the cutter cradle levers 6, 106 and 206 are not operated by the user. In this case, the cutter levers 5, 105 and 205 may be configured to move the cutter cradle 4A, 104A and 204A from the full-cutting position to the half-cutting position and to move the cutter blade 30 from the retracted position to the cutting position by the user operation to the cutter levers 5, 105 and 205, thereby performing the half-cutting operation with respect to the cut target 99. Further, the cutter cradle levers 6, 106 and 206 may be configured to cause the cutter blade 30 to be moved from the retracted position to the cutting position by the user operation to the cutter cradle levers 6, 106 and 206 while maintaining the cutter cradle 4A, 104A and 204A at the full-cutting position, thereby performing the full-cutting operation with respect to the cut target 99.

In the cutting device 1F, the first moving amount L21 of the cutter lever 105 may be greater than the second moving amount L22 of the cutter cradle lever 106. Alternatively, the first moving amount L21 may be equal to the second moving amount L22. Further, the first time period t11 required for the movement of the cutter lever 105 may be greater than the second time period t12 required for the movement of the cutter cradle lever 106, or may be equal to the second time period t12.

Further, the timing at which the movement of the cutter cradle 104A to the full-cutting position by the user operation to the cutter cradle lever 106 is completed (the cutter cradle movement completion timing E11) may be simultaneous with the timing at which the movement of the cutter blade 30 to the cutting position by the user operation to the cutter cradle lever 106 is completed (cutter blade movement completion timing E12).

Further, the first distance L11 between the cutter lever 105 positioned at the half-cutting standby position and the first cutter holder 136 may be smaller than the second distance L12 between the cutter cradle lever 106 positioned at the full-cutting standby position and the second cutter holder 137. Alternatively, the first distance L11 may be equal to the second distance L12.

In the cutting device 1G, the first moving amount L41 of the cutter lever 205 may be greater than the second moving amount L42 of the cutter cradle lever 206, or the first moving amount L41 may be equal to the second moving amount 142. Further, the first time period t21 required for the movement of the cutter lever 205 may be greater than the second time period t22 required for the movement of the cutter cradle lever 206. The first time period t21 may be equal to the second time period t22 instead.

Further, the timing of completion of the movement of the cutter cradle 204A to the full-cutting position by the user operation to the cutter cradle lever 206 (the cutter cradle movement completion timing E21) may be simultaneous with the timing of completion of the cutter blade 30 to the cutting position (the cutter blade movement completion timing E22).

Further, the first distance L311 between the cutter lever 105 positioned at the half-cutting standby position and the cutter blade 30 may be smaller than the second distance L32 between the cutter cradle lever 206 positioned at the full-cutting standby position and the cutter cradle 104A. Alternatively, the first distance L311 may be equal to the second distance L32.

The cutting devices 1F and 1G may be provided with a member corresponding to the interlocking portion 10D provided in the cutting device 1E for moving the cutter lever 105 and 205 in interlocking relation to the cutter cradle lever 106 and 206. Further, with a configuration where the cutter lever 105 and 205 and the cutter cradle lever 106 and 206 are moved in interlocking relation to each other by an interlocking portion, the cutting operation may be switched between the half-cutting operation and the full-cutting operation by switching a direction in which the cutter cradle lever 106 and 206 are operated.

For example, in a case where the cutter cradle lever 106 and 206 are moved in a first moving direction (e.g., the rightward direction) while the cutter lever 105 and 205 and the cutter cradle lever 106 and 206 are movable in interlocking relation to each other by the interlocking portion, the cutter lever 105 and 205 may be moved from the half-cutting standby position to the half-cutting operation position to perform the half-cutting operation with respect to the cut target 99.

On the other hand, in a case where the cutter cradle lever 106 and 206 are moved in a second moving direction (e.g., the leftward direction) while the cutter lever 105 and 205 and the cutter cradle lever 106 and 206 are movable in interlocking relation to each other by the interlocking portion, the cutter cradle lever 106 and 206 may be moved from the full-cutting standby position to the full-cutting operation position to perform the full-cutting operation.

In the cutting devices 1F and 1G with the above configuration, the half-cutting operation by the movement of the cutter levers 105 and 205, and the full-cutting operation by the movement of the cutter cradle levers 106 and 206 can be easily performed just by switching the direction in which the cutter cradle levers 106 and 206 are operated. Note that the switch of the cutting operation between the full-cutting operation and the half-cutting operation may be performed by switching a direction in which the cutter lever 105 and 206 are operated.

In the cutting device 1E, at least one of the first sloped portion 44A of the cutter cradle 4A and the second sloped portion 45A of the holding member 48 may extend in parallel to the front-rear direction. Particularly, the second sloped portion 45A of the holding member 48 may extend in parallel to the front-rear direction, while the first sloped portion 44A of the cutter cradle 4A is inclined downward in the frontward direction. Further, at least one of the first load portion 44B of the cutter cradle 4A and the second load portion 45B of the holding member 48 may extend in parallel to the front-rear direction.

Further, the first sloped portion 44A of the cutter cradle 4A and the second sloped portion 45A of the holding member 48 may be in contact with each other when the cutter cradle 4A is at the half-cutting position. Further, the first load portion 44B of the cutter cradle 4A and the second load portion 45B of the holding member 48 may be separated from each other when the cutter cradle 4A is at the half-cutting position.

The protruding end of the protruding portion 10F of the cover 1D may make contact with the cutter cradle 4A. Further, the cover 1D may not include the protruding portion 10F.

Although the combination of the transparent film tape 99A and the double-sided adhesive tape 99B is employed as an example of the cut target 99 in the above-described embodiments, other object may be the cut target 99. For example, printed paper, label, other kind of tape, tube and the like may be used as the cut target 99, and the cutting operation may be performed with respect to these objects by the cutting devices 1E, 1F, and 1G.

[Remarks]

The rightward direction is an example of a first moving direction. The leftward direction is an example of a second moving direction. The front-rear direction is an example of an extending direction. The frontward direction is an example of a first direction. The rearward direction is an example of a second direction. The up-down direction is an example of an orthogonal direction. The upward direction is an example of a third direction. The downward direction is an example of a fourth direction. The cutting devices 1E, 1F and 1G are examples of a cutting device. The cutter blade 30 is an example of a cutter blade. The cut target 99 is an example of a cut target. The cutting position of the cutter blade 30 is an example of a cutting position. The retracted position of the cutter blade 30 is an example of a retracted position. The cutter cradles 4A, 104A, and 204A are examples of a cutter cradle. The full-cutting position of the cutter cradles 4A, 104A, and 204A are examples of a full-cutting position of the cutter cradle. The half-cutting position of the cutter cradles 4A, 104A, and 204A are examples of a half-cutting position of the cutter cradle. The cutter levers 5, 105 and 205 are examples of a first lever. The half-cutting standby position of the cutter levers 5, 105 and 205 are examples of a first non-operation position of the first lever. The half-cutting operation position of the cutter levers 5, 105 and 205 are examples of a first operation completion position of the first lever. The cutter cradle levers 6, 106 and 206 are examples of a second lever. The full-cutting standby position of the cutter cradle levers 6, 106 and 206 are examples of a second non-operation position of the second lever. The full-cutting operation position of the cutter cradle levers 6, 106 and 206 are examples of a second operation completion position of the second lever. The first moving amounts L21 and L41 are examples of a first moving amount. The second moving amounts L22 and L42 are examples of a second moving amount. The first time periods t11 and t21 are examples of a first time period. The second time periods t12 and t22 are examples of a second time period. The cutter cradle movement completion timings E11 and E21 are examples of a cutter cradle movement completion timing. The cutter blade movement completion timings E12 and E22 are examples of a cutter blade movement completion timing. The cutter holders 132 and 232 are examples of a cutter holder. The first cutter holder 136 is an example of a first contact portion. The second cutter holder 137 is an example of a second contact portion. The first distances L11 and L311 are examples of a first distance. The second distances L12 and L32 are examples of a second distance. The holding member 48 is an example of a holding member. The insertion portion 410 is an example of an insertion portion. The first sloped portion 44A is an example of a first sloped portion. The front end 441 is an example of one end in the first direction of the first sloped portion. The rear end 442 is an example of one end in the second direction of the first sloped portion. The first load portion 44B is an example of a first load portion. The front end 443 is an example of one end in the first direction of the first load portion. The rear end 444 is an example of one end in the second direction of the first load portion. The second sloped portion 45A is an example of a second sloped portion. The front end 451 is an example of one end in the first direction of the second sloped portion. The rear end 452 is an example of one end in the second direction of the second sloped portion. The second load portion 45B is an example of a second load portion. The front end 453 is an example of one end in the first direction of the second load portion. The rear end 454 is an example of one end in the second direction of the second load portion. The printing device 1 is an example of a printing device. The accommodating portion 2 is an example of an accommodating portion. The cover 1D is an example of a cover. The protruding portion 10F is an example of a protruding portion. The printing head 21A is an example of a printing unit.

What is claimed is:

1. A cutting device comprising:

a cutter blade configured to cut a cut target, the cutter blade being movable between:

a cutting position where the cutter blade is configured to perform one of a full-cutting operation and a half-cutting operation with respect to the cut target by making contact with the cut target; and a retracted position where the cutter blade does not make contact with the cut target;

a cutter cradle facing the cutter blade, the cutter cradle being movable between:

a full-cutting position at which the cutter blade is configured to perform the full-cutting operation with respect to the cut target in cooperation with the cutter cradle; and a half-cutting position at which the cutter blade is configured to perform the half-cutting operation with respect to the cut target in cooperation with the cutter cradle;

a first lever configured to be operated by a user, the first lever being configured to make contact with the cutter blade directly or indirectly, the first lever being movable from a first non-operation position to a first operation completion position, the first lever being positioned at the first non-operation position when a user operation to the first lever is not performed, the first lever being positioned at the first operation completion position when the user operation to the first lever has been completed; and a second lever configured to be operated by the user, the second lever being configured to make contact with both the cutter blade and the cutter cradle directly or indirectly, the second lever being movable from a second non-operation position to a second operation completion position, the second lever being positioned at the second non-operation position when a user operation to the second lever is not performed, the second lever being positioned at the second operation completion position when the user operation to the second lever has been completed, wherein a movement of the first lever from the first non-operation position to the first operation completion position causes a movement of the cutter blade from the retracted position to the cutting position, and wherein a movement of the second lever from the second non-operation position to the second operation completion position causes both the movement of the cutter blade from the retracted position to the cutting position and a movement of the cutter cradle between the full-cutting position and the half-cutting position.

2. The cutting device according to claim 1, wherein a first moving amount indicative of an amount of the movement of the first lever from the first non-operation position to the first operation completion position is smaller than a second moving amount indicative of an amount of the movement of the second lever from the second non-operation position to the second operation completion position.

3. The cutting device according to claim 1, wherein, in a case where the first lever and the second lever are operated under the same condition, a first time period indicative of a period of time required for the movement of the first lever from the first non-operation position to the first operation completion position is shorter than a second time period indicative of a period of time required for the movement of the second lever from the second non-operation position to the second operation completion position.

4. The cutting device according to claim 1, wherein a cutter cradle movement completion timing at which the movement of the cutter cradle between the half-cutting position and the full-cutting position caused by the movement of the second lever is completed is earlier than a cutter blade movement completion timing at which the movement of the cutter blade from the retracted position to the cutting position caused by the movement of the second lever is completed.

5. The cutting device according to claim 1, further comprising an interlocking portion for moving the first lever and the second lever in interlocking relation to each other, wherein, in a state where the first lever and the second lever are movable in interlocking relation to each other by the interlocking portion:

in a case where one of the first lever and the second lever is moved in a first moving direction, the first lever is moved from the first non-operation position to the first operation completion position; and in a case where the one of the first lever and the second lever is moved in a second moving direction different from the first moving direction, the second lever is moved from the second non-operation position to the second operation completion position.

6. The cutting device according to claim 1, further comprising a cutter holder holding the cutter blade and movable together with the cutter blade, wherein the first lever causes the movement of the cutter blade by making contact with the cutter blade directly or indirectly through the cutter holder, wherein the second lever causes the movement of the cutter blade by making contact with the cutter blade directly or indirectly through the cutter holder, and wherein the second lever causes the movement of the cutter cradle by making contact with the cutter cradle indirectly through the cutter holder.

7. The cutting device according to claim 6, wherein both the first lever and the second lever are configured to make contact with the cutter blade indirectly through the cutter holder, and wherein the cutter holder comprises:

a first contact portion with which the first lever makes contact; and a second contact portion with which the second lever makes contact.

8. The cutting device according to claim 6, wherein a first distance between the first lever positioned at the first non-operation position and the cutter holder is greater than a second distance between the second lever positioned at the second non-operation position and the cutter holder.

9. The cutting device according to claim 1, further comprising a cutter holder holding the cutter blade and movable together with the cutter blade, wherein the first lever causes the movement of the cutter blade by making contact with the cutter blade directly or indirectly through the cutter holder, wherein the second lever causes the movement of the cutter blade by making contact with the cutter blade directly or indirectly through the cutter holder, and wherein the second lever causes the movement of the cutter cradle by making contact with the cutter cradle directly.

10. The cutting device according to claim 9, wherein a first distance between the first lever positioned at the first non-operation position and the cutter blade is greater than a second distance between the second lever positioned at the second non-operation position and the cutter cradle.

11. The cutting device according to claim 1, further comprising a holding member for moving the cutter cradle, the holding member extending in an extending direction including a first direction and a second direction opposite the first direction, wherein the cutter cradle is formed with an insertion portion into which the holding member is inserted, the holding member penetrating the insertion portion and extending in the second direction in a state where the holding member is inserted into the insertion portion, wherein the cutter cradle comprises a wall portion, the wall portion facing the holding member in an orthogonal direction orthogonal to the extending direction in the state where the holding member is inserted into the insertion portion, the orthogonal direction including a third direction and a fourth direction, the wall portion facing the holding member at a position further in the fourth direction than the holding member, and wherein the wall portion comprises a first sloped portion positioned further in the first direction than the insertion portion, the first sloped portion being sloped with respect to the extending direction such that one end in the first direction of the first sloped portion is positioned further in the fourth direction than one end in the second direction of the first sloped portion.

12. The cutting device according to claim 11, wherein the wall portion of the cutter cradle further comprises a first load portion positioned further in the second direction than the first sloped portion, and wherein the holding member is configured to make contact with the first load portion and to impart a load on the first load portion in the state where the holding member is inserted into the insertion portion.

13. The cutting device according to claim 12, wherein the first load portion is sloped with respect to the extending direction such that one end in the second direction of the first load portion is positioned further in the fourth direction than one end in the first direction of the first load portion.

14. The cutting device according to claim 11, wherein the holding member does not make contact with the first sloped portion and does not impart a load on the first sloped portion in the state where the holding member is inserted into the insertion portion.

15. The cutting device according to claim 11, wherein the holding member comprises a portion, the portion facing the cutter cradle in the orthogonal direction at a position further in the third direction than the cutter cradle in the state where the holding member is inserted into the insertion portion, and wherein the portion of the holding member comprises a second sloped portion positioned further in the first direction than the insertion portion in the state where the holding member is inserted into the insertion portion, the second sloped portion being sloped with respect to the extending direction such that one end in the first direction of the second sloped portion is positioned further in the fourth direction than one end in the second direction of the second sloped portion.

16. The cutting device according to claim 15, wherein the portion of the holding member further comprises a second load portion positioned further in the second direction than the second sloped portion, the second load portion being configured to make contact with the insertion portion and to impart a load on the insertion portion in the state where the holding member is inserted into the insertion portion.

17. The cutting device according to claim 16, wherein the second load portion is sloped with respect to the extending direction such that one end in the second direction of the second load portion is positioned further in the fourth direction than one end in the first direction of the second load portion.

18. The cutting device according to claim 15, wherein the second sloped portion does not make contact with the cutter cradle and does not impart a load on the cutter cradle.

19. A printing device comprising:

an accommodating portion for accommodating therein a cut target;

a cover configured to open and close the accommodating portion, the cover comprising a protruding portion;

a printing unit configured to perform printing on the cut target; and a cutting device comprising:

a cutter blade configured to cut the cut target on which printing has been performed by the printing unit, the cutter blade being movable between:

a cutting position where the cutter blade is configured to perform one of a full-cutting operation and a half-cutting operation with respect to the cut target by making contact with the cut target; and a retracted position where the cutter blade does not make contact with the cut target;

a cutter cradle facing the cutter blade, the cutter cradle being movable between:

a full-cutting position at which the cutter blade is configured to perform the full-cutting operation with respect to the cut target in cooperation with the cutter cradle; and a half-cutting position at which the cutter blade is configured to perform the half-cutting operation with respect to the cut target in cooperation with the cutter cradle;

a first lever configured to be operated by a user, the first lever being configured to make contact with the cutter blade directly or indirectly, the first lever being movable from a first non-operation position to a first operation completion position, the first lever being positioned at the first non-operation position when a user operation to the first lever is not performed, the first lever being positioned at the first operation completion position when the user operation to the first lever has been completed; and a second lever configured to be operated by the user, the second lever being configured to make contact with both the cutter blade and the cutter cradle directly or indirectly, the second lever being movable from a second non-operation position to a second operation completion position, the second lever being positioned at the second non-operation position when a user operation to the second lever is not performed, the second lever being positioned at the second operation completion position when the user operation to the second lever has been completed, wherein the protruding portion protrudes toward the cutter cradle to form a gap between the protruding portion and the cutter cradle in a state where the cover closes the accommodating portion, wherein a movement of the first lever from the first non-operation position to the first operation completion position causes a movement of the cutter blade from the retracted position to the cutting position, and wherein a movement of the second lever from the second non-operation position to the second operation completion position causes both the movement of the cutter blade from the retracted position to the cutting position and a movement of the cutter cradle between the full-cutting position and the half-cutting position.

* * * * *